US009354577B2

(12) United States Patent
Nose et al.

(10) Patent No.: US 9,354,577 B2
(45) Date of Patent: May 31, 2016

(54) IMAGE FORMING APPARATUS

(71) Applicant: CANON KABUSHIKI KAISHA, Tokyo (JP)

(72) Inventors: Katsuya Nose, Matsudo (JP); Fumiyoshi Saito, Toride (JP); Toshihisa Yago, Toride (JP); Naoki Mugita, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/630,883

(22) Filed: Feb. 25, 2015

(65) Prior Publication Data

US 2015/0248097 A1 Sep. 3, 2015

(30) Foreign Application Priority Data

Feb. 28, 2014 (JP) ..... 2014-038532

(51) Int. Cl.
*G03G 15/08* (2006.01)
*G03G 15/00* (2006.01)

(52) U.S. Cl.
CPC ..... *G03G 15/553* (2013.01); *G03G 15/556* (2013.01)

(58) Field of Classification Search
USPC ..... 399/9, 24–30, 38, 53, 58, 59, 252, 258, 399/260
See application file for complete search history.

(56) References Cited

U.S. PATENT DOCUMENTS

| | | | | |
|---|---|---|---|---|
| 5,504,557 | A * | 4/1996 | Morita | G03G 15/0849 399/56 |
| 7,844,191 | B2 * | 11/2010 | Endou | G03G 15/0844 399/101 |
| 8,224,194 | B2 | 7/2012 | Maruyama | |
| 8,401,406 | B2 | 3/2013 | Nose | |
| 8,942,579 | B2 * | 1/2015 | Suenami | G03G 15/0824 399/258 |
| 8,965,227 | B2 * | 2/2015 | Mizutani | G03G 15/1675 399/53 |
| 2007/0104499 | A1 * | 5/2007 | Ariizumi | G03G 15/5062 399/27 |
| 2009/0290885 | A1 | 11/2009 | Maruyama | |
| 2013/0164005 | A1 | 6/2013 | Nose | |
| 2013/0230332 | A1 * | 9/2013 | Ishii | G03G 15/556 399/27 |

FOREIGN PATENT DOCUMENTS

| | | | |
|---|---|---|---|
| JP | 2006-023327 | A | 1/2006 |
| JP | 2009-031453 | A | 2/2009 |
| JP | 2009-282443 | A | 12/2009 |

* cited by examiner

*Primary Examiner* — Hoan Tran
(74) *Attorney, Agent, or Firm* — Fitzpatrick, Cella, Harper & Scinto

(57) ABSTRACT

A controller for an image forming apparatus includes a difference calculating portion for calculating a difference between a consumption value depending on an amount of the toner consumed every predetermined unit and a reference value; and a difference integrating portion. When an integrated value of the difference is larger than a predetermined threshold, the controller executes an operation in a forced consumption mode so that the toner is consumed in an amount corresponding to a predetermined value obtained by multiplying the predetermined threshold by a coefficient of less than 1. When the operation is executed, the integrating portion sets, at a reset value, a value obtained by subtracting the predetermined value from the integrated value at that time. After the operation is executed, the controller executes the operation every time when an integrated value obtained by integrating the reset value and the difference is larger than the predetermined threshold.

15 Claims, 14 Drawing Sheets

| THRESHOLD : PRINT RATIO | VIDEO COUNT Vt | COLOR | | | |
|---|---|---|---|---|---|
| | | Y | M | C | K |
| 0% | 0 | × | × | × | × |
| 1% | 5 | ○ | × | ○ | × |
| 2% | 10 | ○ | ○ | ○ | ○ |
| 3% | 15 | ○ | ○ | ○ | ○ |
| 4% | 20 | ○ | ○ | ○ | ○ |
| 5% | 26 | ○ | ○ | ○ | ○ |

| LOW-DUTY-BLACK | COLOR | | | |
|---|---|---|---|---|
| | Y | M | C | K |
| PRINT RATIO(%) | 5 | 5 | 5 | 1 |
| V | 26 | 26 | 26 | 5 |
| Vt | 5 | 10 | 5 | 10 |
| Vt-V | -21 | -16 | -21 | 5 |
| ADDED TO X | -21 | -16 | -21 | 5 |

| HIGH-DUTY-BLACK | COLOR | | | |
|---|---|---|---|---|
| | Y | M | C | K |
| PRINT RATIO(%) | 5 | 5 | 5 | 100 |
| V | 26 | 26 | 26 | 512 |
| Vt | 5 | 10 | 5 | 10 |
| Vt-V | -21 | -16 | -21 | -502 |
| ADDED TO X | -21 | -16 | -21 | -502 |

FIG.10

| PRINT RATIO (1000 SHEETS) | VIDEO COUNT (1000 SHEETS) | COEFFICIENT Z |
|---|---|---|
| 0 — 2% | 0 — 9 | 60% |
| 2 — 5% | 10 — 25 | 50% |
| 5 — 10% | 26 — 50 | 40% |
| 10 — 100% | 51 — 512 | 30% |

FIG.15

IMAGE FORMING APPARATUS

FIELD OF THE INVENTION AND RELATED ART

The present invention relates to an image forming apparatus, such as a copying machine, a printer, a facsimile machine or a multi-function machine having a plurality of functions of these machines. Particularly, the present invention relates to a constitution having a forced consumption mode in which a developer is forcedly consumed.

Generally, in the image forming apparatus of an electrophotographic type, when a proportion in which an image having a low image ratio (print ratio) is formed is large, a proportion of a toner transferred from a developing sleeve in a developing device onto a photosensitive drum becomes small. In such a state, when the developing device is continuously driven for a long time, toner deterioration generates, and therefore an image defect such as toner scattering or fog is liable to occur. For this reason, an operation in which the toner is forcedly consumed by the developing device has been conventionally performed.

For example, in the case where a value as an index of an amount of the toner used every image formation is smaller than a set threshold, a difference between the value and the set threshold is calculated, and when an integrated value obtained by integrating the calculated difference reaches a predetermined value, forced consumption of the toner is executed. Such an invention has been proposed (Japanese Laid-Open Patent Application (JP-A) 2006-23327).

For example, in the case where an image for which a toner consumption amount is large (i.e., an image ratio is high) is formed immediately after a forced consumption operation of the toner is executed, the toner deterioration is eliminated in some cases by this image formation even when the forced consumption operation of the toner (operation in a forced consumption mode) immediately before the image formation is not executed. In such cases, the toner consumption amount by the forced consumption operation of the toner immediately before the image formation becomes excessive relative to a toner consumption amount necessary to eliminate the toner deterioration.

SUMMARY OF THE INVENTION

The present invention has been accomplished in view of the above-described circumferences. A principal object of the present invention is to provide an image forming apparatus capable of suppressing a toner consumption amount while suppressing toner deterioration.

According to an aspect of the present invention, there is provided an image forming apparatus comprising: an image bearing member; a developing device for developing an electrostatic latent image, supplying device for supplying the toner to said developing device depending on a consumption amount of a developer; and a controller capable of executing an operation in a forced consumption mode in which the toner is forcedly consumed by said developing device, wherein said controller includes: a difference calculating portion for calculating a difference between a consumption value depending on an amount of the toner consumed every predetermined unit of image formation and a reference value set for the predetermined unit; and an integrating portion for integrating the difference to obtain an integrated value, wherein when the integrated value is larger than a predetermined threshold, said controller executes the operation in the forced consumption mode so that the toner is consumed in an amount corresponding to a value obtained by multiplying the predetermined threshold by a coefficient of less than 1, wherein when the operation in the forced consumption mode is executed, said integrating portion sets, at a reset value, a value obtained by subtracting the value, obtained by multiplying the predetermined threshold by the coefficient, from the integrated value at the time when the operation is executed, and wherein after the operation in the forced consumption mode is executed, said controller executes the operation in the forced consumption mode every time when an integrated value obtained by integrating the reset value and the difference is larger than the predetermined threshold.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 10 includes tables showing parameters in the cases of low-duty-black and high-duty-black, respectively.

FIG. 15 is a table showing a relationship among an average print ratio, an average video count and a forced consumption amount coefficient of an image forming apparatuses in the Second Embodiment.

DESCRIPTION OF THE PREFERRED EMBODIMENTS

<First Embodiment>

A first Embodiment of the present invention will be described with reference to FIGS. 1-13. First, a general structure of an image forming apparatus in this embodiment will be described with reference to FIGS. 1-3.

[Image Forming Apparatus]

Figure 1:
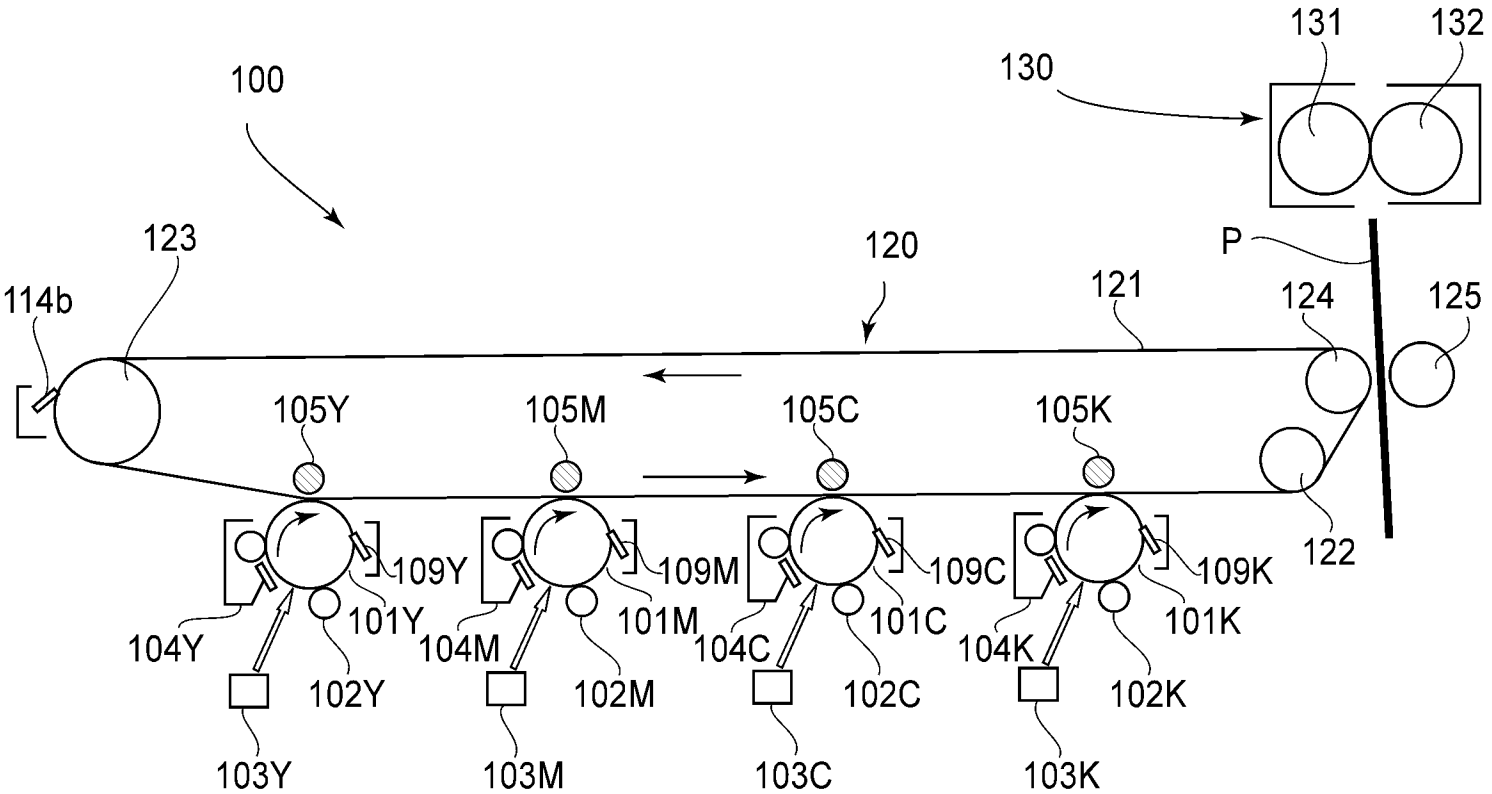
FIG. 1 is a schematic sectional view of an image forming apparatus according to a First Embodiment of the present invention.
Figure 2:
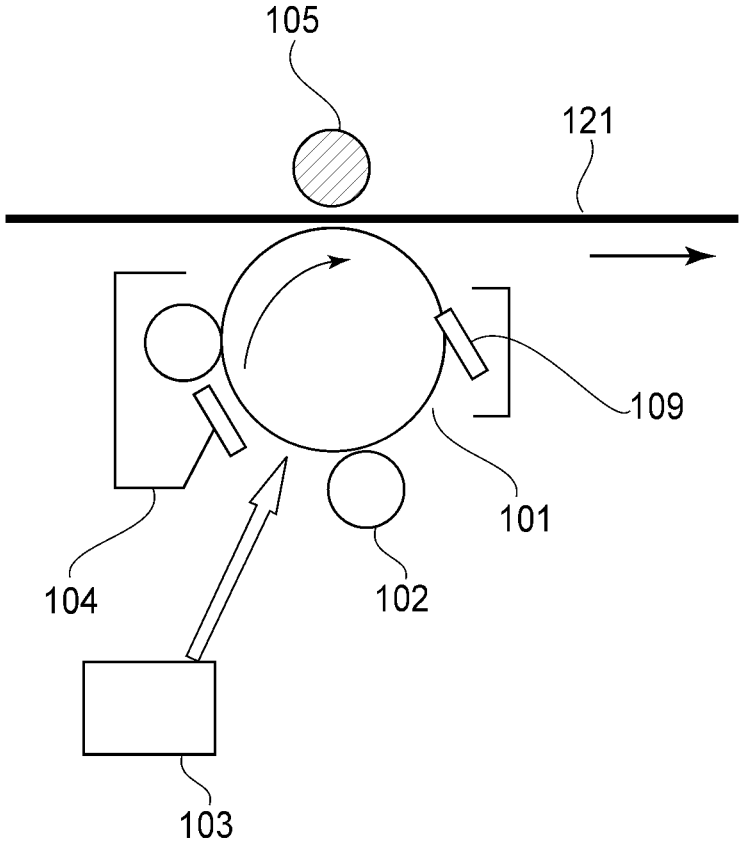
FIG. 2 is a schematic sectional view of an image forming station in the First Embodiment.

As shown in FIG. 1, an image forming apparatus 100 in this embodiment includes four image forming stations Y, M, C and K provided with photosensitive drums 101 (101Y, 101M, 101C and 101K) as an image bearing member. On each of the image forming stations, an intermediary transfer device 120 is disposed. The intermediary transfer device 120 is constituted so that an intermediary transfer belt 121 as an intermediary transfer member is stretched by rollers 122, 123 and 124 and is moved in a direction indicated by arrows.

At peripheries of the photosensitive drums 101, primary charging devices 102 (102Y, 102M, 102C and 102K), developing devices 104 (104Y, 104M, 104C and 104K), cleaners 109 (109Y, 109M, 109C and 109K) and the like are provided. Constitutions and an image forming operation at the peripheries of the photosensitive drums will be described with reference to FIGS. 1 and 2. The constitutions around the photosensitive drums for the respective colors are similar to each other, and therefore there is no need to particularly distinguish the constitutions, suffixes representing the constitutions of the image forming stations for the respective colors will be omitted from description.

The photosensitive drum 101 is rotationally driven in an arrow direction. The surface of the photosensitive drum 101 is electrically charged uniformly by the primary charging device of a charging roller type using contact charging. The surface of the charged photosensitive drum 1 is exposed to light by a laser emitting device 103 as an exposure device, so that an electrostatic latent image is formed. The thus-formed electrostatic latent image is visualized with a toner by the developing device 104, so that a toner image is formed on the photosensitive drum 101. At the image forming stations, the toner images of yellow (Y), magenta (M), cyan (C) and black (K) are formed, respectively.

The toner images formed at the respective image forming stations are transferred and superposed on the intermediary transfer belt 121 of polyimide resin by a transfer bias with the primary transfer rollers 105 (105Y, 105M, 105C and 105K). The four-color toner images formed on the intermediary transfer belt 121 are transferred onto recording material (e.g., a sheet material such as a sheet or an OHP sheet) P by a secondary transfer roller 125 as a secondary transfer means disposed opposite to the roller 124. The toner remaining on the intermediary transfer belt 121 without being transferred onto the recording material P is removed by an intermediary transfer belt cleaner 114*b*. The recording material P on which the toner images are transferred is pressed and heated by a fixing device 130 including fixing rollers 131 and 132, so that the toner image is fixed. Further, primary transfer residual toners remaining on the photosensitive drums 101 after the primary transfer are removed by cleaners 109, so that the image forming apparatus prepares for subsequent image formation.

Next, a system constitution of an image processing unit in the image forming apparatus 100 in this embodiment will be described with reference to FIG. 3.

Figure 3:
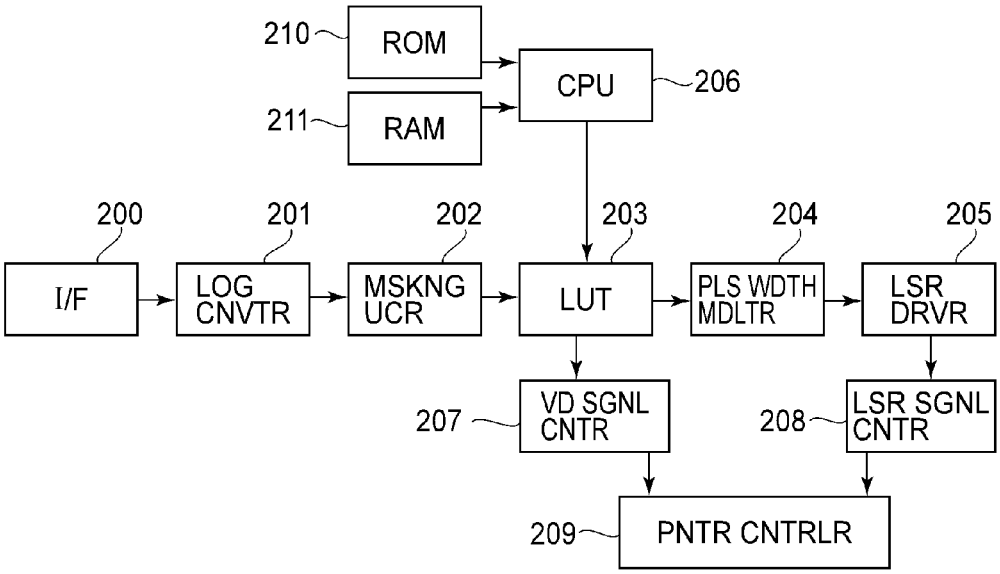
FIG. 3 is a block diagram showing a system constitution of the image forming apparatus in the First Embodiment.

Referring to FIG. 3, through an external input interface (I/F) 200, color image data as RGB image data are input from an unshown external device such as an original scanner or a computer (information processing device) as desired. A LOG conversion portion 201 converts luminance data of the input RGB image data into CMY density data (CMY image data) on the basis of a look-up table constituted (prepared) by data or the like stored in an ROM 210. A masking UCR portion 202 extracts a black (K) component data from the CMY image data and subjects CMYK image data to matrix operation in order to correct color shading of a recording colorant. A look-up table portion (LUT portion) 203 makes density correction of the input CMYK image data every color by using a gamma (γ) look-up table in order that the image data are caused to coincide with an ideal gradation characteristic of a printer portion. Incidentally, the γ look-up table is prepared on the basis of the data developed on an RAM 211 and the contents of the table are set by a CPU 206. A pulse width modulation portion 204 outputs a pulse signal with a pulse width corresponding to image data (image signal) input from the LUT portion 203. On the basis of this pulse signal, a laser driver 205 drives the laser emitting element 103 to irradiate the surface of the photosensitive drum 101 with laser light, so that the electrostatic latent image is formed on the photosensitive drum 101.

A video signal count portion 207 adds up a level for each pixel (0 to 255 level) for a screenful of the image (with respect to 600 dpi in this embodiment) of the image data input into the LUT portion 203. The integrated value of the image data is referred to as a video count value. A maximum of this video count value is 1023 in the case where all the pixels for the output image are at the 255 level. Incidentally, when there is a restriction on the constitution of the circuit, by using a laser signal count portion 208 in place of the video signal count portion 207, the image signal from the laser drive 205 is similarly calculated, so that it is possible to obtain the video count value.

<Constitution of Developing Device>

Figure 4:
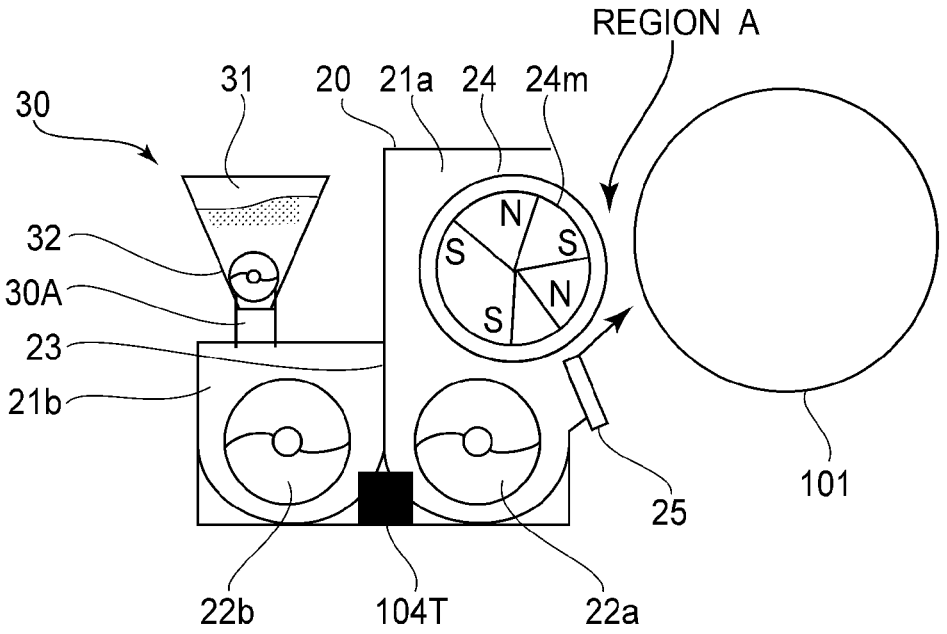
FIG. 4 is a schematic cross-sectional view of a developing device in the First Embodiment.
Figure 5:
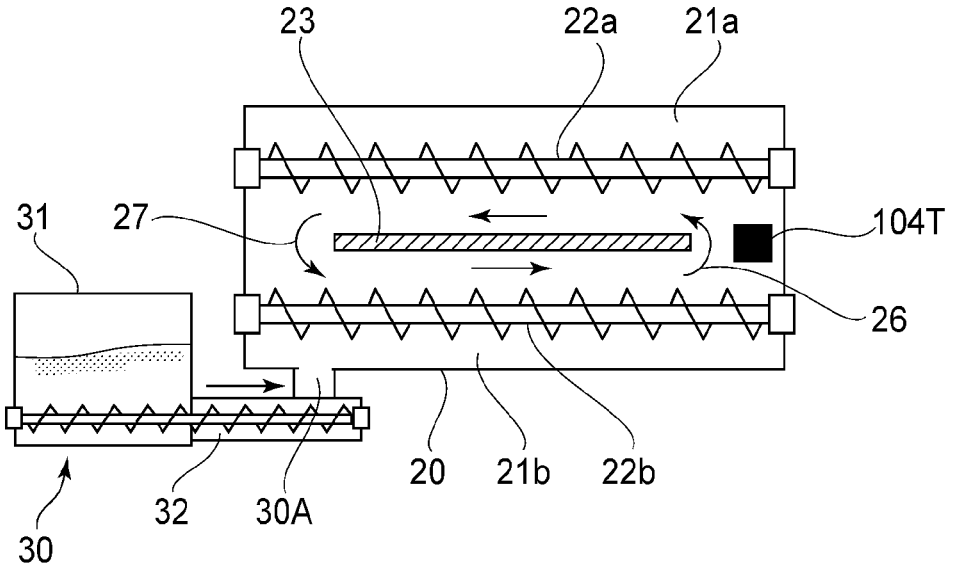
FIG. 5 is a schematic longitudinal sectional view of the developing device in the First Embodiment.
Figures 6, 7:
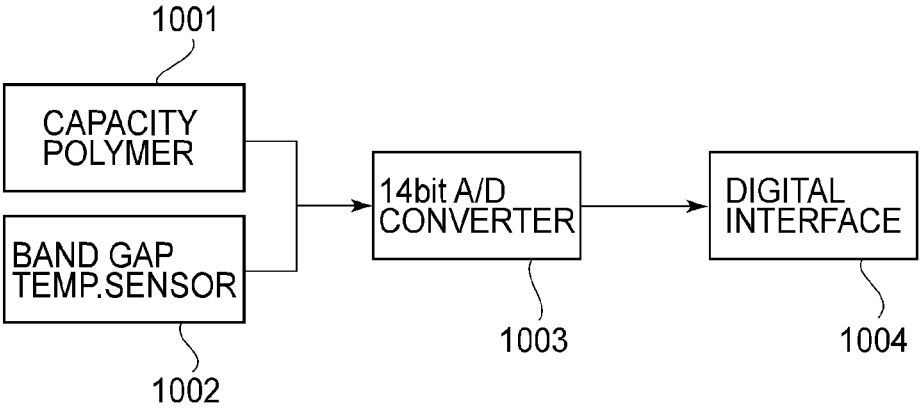
FIG. 6 is a control block diagram of a temperature sensor provided in the developing device in the First Embodiment.
FIG. 7 is a table showing a result of an experiment in which a toner deterioration threshold video count Vt for each of colors is measured.

The developing device 104 in this embodiment will be further described specifically with reference to FIGS. 4-6. The developing device 104 in this embodiment includes a developing container 20, in which a two component developer including toner and a carrier is stored. The developing device 104 also includes a developing sleeve 24 as a developer carrying means and a trimming member 25 for regulating a magnetic brush chain formed of the developer carried on the developing sleeve 24, in the developing container 20.

The inside of the developing container 20 is horizontally divided by a partition wall 23 into a developing chamber 21*a* and a stirring chamber 21*b*. The partition wall 23 extends in the direction perpendicular to the drawing sheet of FIG. 4. The developer is stored in the developing chamber 21*a* and the stirring chamber 21*b*. In the developing chamber 21*a* and the stirring chamber 21*b*, first and second feeding screws 22*a* and 22*b* which are feeding members as developer stirring and feeding means are disposed, respectively. As shown in FIG. 5, the first feeding screw 22*a* is disposed, at the bottom portion of the developing chamber 21*a*, roughly in parallel to the axial direction of the developing sleeve 24. It conveys the developer in the developing chamber 21*a* in one direction parallel to the axial line of the developing sleeve 24 by being rotated. The second feeding screw 22*b* is disposed, at the bottom portion of the stirring chamber 21*b*, roughly in parallel to the first feeding screw 22*a*. It conveys the developer in the stirring chamber 21*b* in the direction opposite to that of the first feeding screw 22*a*.

Thus, by the feeding of the developer through the rotation of the first and second feeding screws 22*a* and 22*b*, the developer is circulated between the developing chamber 21*a* and the stirring member 21*b* through openings 26 and 27 (that is, communicating portions) present at both ends of the partition wall 23 (FIG. 5). In this embodiment, the developing chamber 21*a* and the stirring chamber 21*b* are horizontally disposed. However, the present invention is also applicable to a developing device in which the developing chamber 21*a* and the stirring chamber 21*b* are vertically disposed and developing devices of other types.

The developing container 20 is provided with an opening at a position corresponding to a developing region A wherein the developing container 20 opposes the photosensitive drum 101. At this opening, the developing sleeve 24 is rotatably disposed so as to be partially exposed toward the photosensitive drum 101. In this embodiment, the diameters of the developing sleeve 24 and the photosensitive drum 101 are 20 mm and 30 mm, respectively, and a distance in the closest area between the developing sleeve 24 and the photosensitive drum 101 is about 300 μm. By this constitution, development can be effected in a state in which the developer fed to a developing region A is brought into contact with the photosensitive drum 101.

Incidentally, the developing sleeve 24 is formed of nonmagnetic material such as aluminum and stainless steel and inside thereof a magnetic roller 24*m* as a magnetic field generating means is non-rotationally disposed.

In the constitution described above, the developing sleeve 24 is rotated in the direction indicated by an arrow (counterclockwise direction) to carry the two component developer regulated in its layer thickness by cutting of the chain of the magnetic brush with the trimming member 25. Then, the developing sleeve 24 conveys the layer thickness-regulated developer to the developing region A in which the developing sleeve 24 opposes the photosensitive drum 101, and supplies the developer to the electrostatic latent image formed on the photosensitive drum 101, thus developing the latent image. At this time, in order to improve development efficiency, i.e., a rate of the toner imparted to the latent image, a developing bias voltage in the form of a DC voltage biased or superposed with an AC voltage is applied to the developing sleeve 24 from a power source. In this embodiment, the developing bias is a combination of a DC voltage of −500 V, and an AC voltage which is 1,800 V in peak-to-peak voltage Vpp and 12 kHz in frequency f. However, the DC voltage value and the AC voltage waveform are not limited to those described above.

In the two component magnetic brush developing method, generally, the application of AC voltage increases the development efficiency and therefore the image has a high quality but on the other hand, fog is liable to occur. For this reason, by providing a potential difference between the DC voltage applied to the developing sleeve 24 and the charge potential of the photosensitive drum 101 (i.e., a white background portion potential), the fog is prevented.

The trimming member (regulating blade) 25 is constituted by a nonmagnetic member formed with an aluminum plate or the like extending in the longitudinal axial direction of the developing sleeve 24. The trimming member 25 is disposed upstream of the photosensitive drum 1 with respect to the developing sleeve rotational direction. Both the toner and the carrier of the developer pass through the gap between an end of the trimming member 25 and the developing sleeve 24 and are sent into the developing region A.

Incidentally, by adjusting the gap between the trimming member 25 and the developing sleeve 24, the trimming amount of the magnetic brush chain of the developer carried on the developing sleeve 24 is regulated, so that the amount of the developer sent into the developing region A is adjusted. In this embodiment, a coating amount per unit area of the developer on the developing sleeve 24 is regulated at 30 mg/cm$^2$ by the trimming member 25.

The gap between the trimming member 25 and the developing sleeve 24 is set at a value in the range of 200-1,000 μm, preferably, 300-700 μm. In this embodiment, the gap is set at 500 μm.

Further, in the developing region A, the developing sleeve 24 of the developing device 104 moves in the same direction as the movement direction of the photosensitive drum 101 at a peripheral speed ratio of 1.80 by which the developing sleeve 24 moves at the peripheral speed which is 1.80 times that of the photosensitive drum 101. With respect to the peripheral speed ratio, any value may be set as long as the set value is in the range of 0-3.0, preferably, 0.5-2.0. The greater the peripheral (moving) speed ratio, the higher the development efficiency. However, when the ratio is excessively large, problems such as toner scattering and developer deterioration occur. Therefore, the ratio is desired to be set in the above-mentioned range.

Further, at the opening (communicating portion) 26 in the developing container 20, as a temperature detecting means for the developer, a temperature sensor 104T is disposed. The disposition place of the temperature sensor 104T in the developing container 20 may desirably be a position in which a sensor surface is buried in the developer in order to improve detection accuracy.

Here, the temperature sensor 104T will be described more specifically with reference to FIG. 6. In this embodiment, as the temperature sensor 104T, a temperature/humidity sensor ("SHT1X series", mfd. by Sensirion Co., Ltd.) was used. The temperature sensor 104T includes a sensing element 1001 of an electrostatic capacity polymer as a humidity detecting device and includes a band gap temperature sensor 1002 as a temperature detecting device. The temperature sensor 104T is a CMOS device having such a specification that outputs of the sensing element 1001 and band gap temperature sensor 1002 are coupled by a 14 bit-A/D converter 1003 and serial output is performed through a digital interface 1004.

The band gap temperature sensor 1002 as the temperature detecting device uses a thermistor linearly changed in resistance value with respect to the temperature and calculates the temperature from the resistance value. Further, the sensing element 1001 as the humidity detecting device is a capacitor in which a polymer is inserted as a dielectric member. The sensing element 1001 detects the humidity by converting the electrostatic capacity into the humidity by utilizing such a property that the content of water which is adsorbed by the polymer is changed depending on the humidity and as a result, the electrostatic capacity of the capacitor is linearly changed with respect to the humidity.

The temperature sensor 104T used in this embodiment can detect both of the temperature and the humidity. However, actually, only a detection result of the temperature is utilized, so that the use of other sensors capable of detecting only the temperature may also be sufficient.

[Supply of Developer]

A supplying method of the developer in this embodiment will be described with reference to FIGS. 4 and 5. At an upper portion of the developing device 104, a toner supplying device 30 as a supplying means for supplying the toner to the developing device 104 depending on a consumption amount of the developer is provided. The toner supplying device 30 includes a hopper 31 accommodating a two-component developer for supply in which the toner and a carrier are mixed (ordinarily in a (toner/developer for supply) ratio of 100% to 80%). The hopper 31 includes a screw-shaped supplying member, i.e., a supplying screw 32 at a lower portion thereof, and an end of the supplying screw 32 extends to a position of a developer supplying opening 30A provided at a rear end portion of the developing device 104.

The toner in an amount corresponding to an amount of the toner consumed by the image formation is passed from the hopper 31 through the developer supplying opening 30A and is supplied into the developing device 104 by a rotational force of the supplying screw 32 and the force of gravitation of the developer. The amount of the developer for supply to be supplied from the hopper 31 into the developing device 104 is roughly determined by the number of rotations of the supplying screw 32. This number of rotations is determined by a CPU 206 (FIG. 3) as a control means on the basis of a video count value of the image data, a detection result of an unshown toner content (concentration) detecting means provided in the developing container 20, or the like.

Here, the two component developer, which comprises the toner and the carrier, stored in the developing container 20 will be described more specifically.

The toner contains primarily binder resin, and coloring agent. If necessary, particles of coloring resin, inclusive of other additives, and coloring particles having external additive such as fine particles of choroidal silica, are externally added to the toner. The toner is negatively chargeable polyester-based resin and is desired to be not less than 4 μm and not more than 10 μm, preferably not more than 8 μm, in volume-average particle size. Further, as the toner in recent years, a toner having a low melting point or a toner having a low glass transition point Tg (e.g., ≤70° C.) is used in many cases in order to improve a fixing property. In some cases, in order to further improve the fixing property, a wax is incorporated in the toner. The developer in this embodiment contains a pulverization toner in which the wax is incorporated.

As for the material for the carrier, particles of iron, the surface of which has been oxidized or has not been oxidized, nickel, cobalt, manganese, chrome, rare-earth metals, alloys of these metals, and oxide ferrite are preferably usable. The method of producing these magnetic particles is not particularly limited. A weight-average particle size of the carrier may be in the range of 20-60 μm, preferably, 30-50 μm. The carrier may be not less than $10^7$ ohm·cm, preferably, not less than $10^8$ ohm·cm, in resistivity. In this embodiment, the carrier with a resistivity of $10^8$ ohm·cm was used.

Incidentally, the volume-average particle size of the toner used in this embodiment was measured by using the following device and method. As the measuring device, a sheath-flow electric resistance type particle size distribution measuring device ("SD-2000", manufactured by Sysmex Corp.) was used. The measuring method was as follows. To 100-150 ml of an electrolytic solution which is a 1%-aqueous NaCl solution prepared using reagent-grade sodium chloride, 0.1 ml of a surfactant as a dispersant, preferably, alkylbenzenesulfonic acid salt, was added, and to this mixture, 0.5-50 mg of a measurement sample was added.

Then, the electrolytic solution in which the sample was suspended was dispersed for about 1-3 minutes in an ultrasonic dispersing device. Then, the particle size distribution of the sample, the size of which is in the range of 2-40 μm was measured with the use of the above-mentioned measuring device ("SD-2000") fitted with a 100 μm aperture, and the volume-average distribution was obtained. Then, a volume-average particle size was obtained from the thus-obtained volume-average distribution.

Further, the resistivity of the carrier used in this embodiment was measured by using a sandwich type cell with a measurement electrode area of 4 $cm^2$ and a gap between two electrodes of 0.4 cm. A voltage E (V/cm) was applied between the two electrodes while applying 1 kg of weight (load) to one of the electrodes, to obtain the resistivity of the carrier from the amount of the current which flowed through the circuit.

[Forced Consumption Mode]

An operation in a forced consumption mode in this embodiment will be described with reference to FIGS. 7-13. First, in the image forming apparatus 100, in the case where an image having a low image formation ratio (print ratio), i.e., a low-duty image, is continuously formed, the operation in the forced consumption mode in which the toner is forcedly consumed is executable after the image formation is interrupted or during post-rotation with an end of an image forming job.

That is, in the case where the low-duty image is continued, the proportion of the toner transferred from the inside of the developing container 20 onto the photosensitive drum 101 becomes small. For this reason, the toner in the developing container 20 is subjected to stirring of the first and second feeding screws 22*a* and 22*b* and rubbing at the time of passing through the trimming member 25, for a long time. As a result, the above-described external additive for the toner comes off the toner or is buried in the toner surface, so that the flowability or charging property of the toner is lowered and thus the image quality is deteriorated. Therefore, in general, the operation in the forced consumption mode in which after the image formation is interrupted (downtime is provided) or during the post-rotation, the deteriorated toner in the developing device 104 is used for the development in a non-image region and thus is forcedly discharged (consumed) is executed.

[Setting of Toner Deterioration Threshold]

First, setting of a toner deterioration threshold as a reference value which is used for executing the operation in the forced consumption mode and which is set for a predetermined unit of image formation will be described. The predetermined unit of image formation in a unit, set for effecting the image formation, such as a single A4-sized recording material. The predetermined unit is not limited thereto, but may also be any size such as A3 or B5, and may also be appropriately set depending on the size or status of use, such as ½ sheet or plural sheets, principally used in the image forming apparatus. In this embodiment, one sheet of the A4-sized recording material is used as the predetermined unit (of image formation).

As described above, in the case where the proportion of the toner transferred onto the photosensitive drum is small and the amount of the toner supply into the developing container 20 is small, i.e., in the case where the print ratio is low, the toner deterioration has gone. As a value (the reference value described above) indicating that a lowering in image quality due to the toner deterioration generates when the print ratio is low to what extent, in this embodiment, a "toner deterioration threshold video count Vt" is set.

The toner deterioration threshold video count Vt can be calculated by an experiment described below. For example, in this embodiment, continuous one-side-image formation of 1,000 A4-sized sheets was effected while changing the print ratio (from 0% to 5%) for each of the colors, so that a change in image quality before and after the continuous image formation is surveyed. A result of this experiment is shown in a table of FIG. 7. In FIG. 7, "o" represents the image quality deterioration did not occur, and "x" represents that the image quality deterioration occurs in terms of at least one of lowering in degree of fog, toner scattering, and graininess.

Accordingly, from FIG. 7, in this embodiment, the image deterioration due to the toner deterioration generates when the print ratio for the associated color is lower than 1% for yellow (Y), 2% for magenta (M), 1% for cyan (C) and 2% for black (K). Further, the video count of a whole surface solid image (image having the print ratio of 100%) one surface (side) of the A4-sized sheet for a certain color is 512 in this embodiment. In this embodiment, the video count corresponds to a consumption value depending on an amount of the toner consumed every predetermined unit of image formation. From the above, the toner deterioration threshold video count Vt in this embodiment is Vt(Y)=5, Vt(M)=10, Vt(C)=5 and Vt(K)=10. In calculation of the toner deterioration threshold video count Vt, the fractional portion thereof was rounded off to the closest whole number.

Further, the toner deterioration threshold video count Vt varies depending on the material or the like of the developer (the toner and the carrier), and therefore may be appropriately calculated and set.

[Discrimination as to Whether or not Operation in Forced Consumption Mode can be Executed]

Next, discrimination as to whether or not the operation in the forced consumption mode can be executed will be described with reference to FIG. 8. As a precondition, a concept of the operation in the forced consumption mode for each of the colors is the same. Therefore, the colors are omitted from description in the following flow-charts and the like in some cases, but in that cases, common control is effected for each of the colors. In this embodiment, as an easy-to-understand example, the case where such an image that the print ratios per (one) sheet for the colors of Y, M, C and K are 5% for Y, 5% for M, 5% for C and 1% for K (hereinafter, this image is referred to as a "low-duty-black image chart") is continuously formed on A4-sized sheets is considered.

When the image formation is started, the video signal count portion 207 shown in FIG. 3 calculates video counts V(K), V(M), V(C) and V(K) for the respective colors. That is, the above-described consumption amount is calculated (step S1). In this embodiment, the video count of the whole (entire) surface solid image (the image with the print ratio of 100%) on one surface (side) of A4-sized sheet for a certain color is 512. The video counts of the "low-duty-black image chart" are V(Y)=26, V(M)=26, V(C)=26 and V(K)=15. Here, when each video count is calculated, the fractional portion of the number is rounded off to the nearest integer.

Then, the toner deterioration threshold video count Vt is calculated from the table of the toner deterioration threshold video count Vt, shown in FIG. 7, stored in the RAM 211 in FIG. 3 (step S2). That is, the reference value set for the predetermined unit is calculated. From FIG. 7, the toner deterioration threshold video count Vt for Y and C is 5, and the toner deterioration threshold video count Vt for M and K is 10. The toner deterioration threshold video count Vt represents a threshold at which the image quality can be maintained, and shows that the toner deterioration goes when the image having the print ratio and the video count smaller than Vt is outputted.

Then, the above-described difference between the video count V and the toner deterioration threshold video count Vt, i.e., Vt−V is calculated (step S3). That is, the CPU 206 also as a difference calculating means calculates the difference (Vt−V) by subtracting the video count (consumption amount) from the toner deterioration threshold video count Vt (reference value). This difference is a deterioration information determined on the basis of the consumption value and the reference value. The CPU 206 also as an integrating means adds (integrates) the difference (Vt−V) to a toner deterioration integrated value X which is an integrated value, irrespective of the sign (positive or negative) of the value of (Vt−V) (step S4). The toner deterioration integrated value X is an index indicating a current toner deterioration state, and is the integrated value of the video count value calculated by (Vt−V). Accordingly, in the case where use of the developing device is started from an unused state (when the developer is a new developer (e.g., immediately after exchange of the developing device)), the toner deterioration integrated value X is zero. Further, the difference (Vt−V) corresponds to "a value relating to an amount of the toner consumed every predetermined unit of image formation" recited in the present invention.

When the step S4 is specifically described, e.g., in the case where the print ratio is low, the value of V is small, so that the value of (Vt−V) is a positive value. By adding the above-calculated positive value of (Vt−V) to the toner deterioration integrated value X, the resultant value represents a state in which the toner deterioration goes. On the other hand, e.g., in the case where the print ratio is high, the value of V is large, so that the value of (Vt−V) is a negative value. By adding the above-calculated negative value of (Vt−V) to the toner deterioration integrated value X, the resultant value represents a state in which the toner is recovered from the toner deterioration state. That is, the value represents the state in which the toner is recovered from the toner deterioration state by newly supplying the toner by supply control after the toner is consumed at the high print ratio.

Then, the CPU 206 also as a control means discriminates the sign (positive or negative) of the latest toner deterioration integrated value X calculated in the step S4 (step S5). Then, in the case where the toner deterioration integrated value X is a negative value, the toner deterioration integrated value X is reset to zero (step S6). That is, in this case, a state in which the toner deterioration is reset by the consumption of the high print ratio toner and then by supply of the (new) toner is formed. Accordingly, the toner deterioration integrated value X is reset to zero, and subsequently image formation is executed (returned to step S1).

On the other hand, in the case where the toner deterioration integrated value X is a positive value.

With respect to the toner deterioration integrated value X calculated and updated every image formation in the above steps, the CPU 206 calculates a difference (A−X) of the toner deterioration integrated value X from a discharge execution threshold A which is a predetermined threshold (step S7). Here, the discharge execution threshold A is a predetermined threshold value which is arbitrarily settable. The smaller the discharge execution threshold A, the higher the frequency of execution of the operation in the forced consumption mode (toner discharging operation) even in the continuous image formation at the same print ratio. The discharge execution threshold A is set at 512 in this embodiment. When the set value of the discharge execution threshold A is excessively large, a time in which the toner deterioration goes until the operation in the forced consumption mode is performed is long, so that it is desirable that the set value is approximately equal to the video count value of the whole surface solid image (the image with the print ratio of 100%) on one surface of A4-sized sheet to A3-sized sheet. Further, e.g., with a larger volume of the developer which can be retained in the developing container 20, there is a tendency that the toner discharge execution threshold A can be set at a larger value.

Then, the CPU 206 also as an executing means discriminates the sign (positive or negative) of the difference (A−X), calculated in the step S7, between the toner deterioration integrated value X and the discharge execution value A (step S8). In the case where the difference (A−X) is positive or zero, i.e., in the case where the toner deterioration integrated value X (integrated value) is not more than the discharge execution threshold A (i.e., not more than the predetermined threshold), the operation in the forced consumption mode is not executed (step S9). That is, in this case, the toner deterioration does not go to the extent that the operation in the forced consumption mode is required to be executed immediately, and therefore the operation in the forced consumption mode is not executed and subsequently the image formation is executed. At this time, the toner deterioration integrated value X is continuously used as it is. That is, to the toner deterioration integrated value X at that time, a subsequent difference (Vt−V) is added (integrated).

On the other hand, in the case where the difference (A−X) is negative, i.e., in the case where the toner deterioration integrated value X (integrated value) is larger than the discharge execution value A (predetermined threshold), the operation in the forced consumption mode is executed (step S10). That is, in this case, the toner deterioration sufficiently goes, and therefore there is a need to execute the operation in the forced consumption mode immediately. For this reason, the image formation is interrupted and then the operation in the forced consumption mode is executed. After the operation in the forced consumption mode is executed, the image formation is started again.

COMPARISON EXAMPLE

The operation in the forced consumption mode in a Comparison Example will be described with reference to FIG. 9. In the above-described step S10 of FIG. 8, in the case where the difference (A−X) is the negative value, the image formation is interrupted and then the operation in the forced consumption mode is executed. First, to the primary transfer roller 105, a primary transfer bias of an opposite polarity to that during the normal image formation (i.e., the transfer bias of an identical polarity to the charge polarity of the toner image on the photosensitive drum 101) is applied (step S21). Next, the toner in the amount corresponding to the video count equivalent to the discharge execution threshold A is discharged onto the photosensitive drum 101 (step S22). In the Comparison Example, the discharge execution threshold A is set at 512 (corresponding to the video count of the image of the whole surface solid print ratio of 100%), so that an operation of discharging the whole surface solid image formed on one surface of the A4-sized recording material is executed. Further, the latent image, on the photosensitive drum 101, for the toner discharging may desirably be the whole surface solid image with respect to the longitudinal direction (rotational axis direction) of the photosensitive drum 101 in order to minimize the downtime generated by the discharging.

Then, the toner discharged on the photosensitive drum is not transferred onto the intermediary transfer belt since the primary transfer bias has the same polarity as that of the toner, and is collected by a photosensitive drum cleaner 109 (step S23). Here, the toner deterioration integrated value X is reset to zero (step S24). Finally, the primary transfer bias is returned to that of the polarity during the normal image formation (step S25), the operation in the forced consumption mode is ended and the normal image forming operation is resumed.

In the operation in the forced consumption mode in Comparison Example, the case where the "low-duty-black image chart" is formed on 104 sheets in a one-sheet intermittent mode, and then the high-duty-black image chart" is formed on one sheet will be considered specifically. Incidentally, the one-sheet intermittent mode refers to the case where the image is formed on one sheet in a single (one) job, and in the one-sheet intermittent mode, an operation including pre-rotation, image formation of one sheet and post-rotation is performed. Further, as described above, the "low-duty-black image chart" is a chart such that the image of Y=5%, M=5%, C=5% and K=1% is formed on one surface of the A4-sized recording material. Further, the "high-duty-black image chart" is a chart such that the image is Y=5%, M=5%, C=5% and K=100% is formed on one surface of the A4-sized recording material.

First, in the case where each of the "low-duty-black image chart" and the "high-duty-black image chart" is formed on one surface of each of A4-sized sheets, how to add (integrate) the toner deterioration integrated value X for each color in the operation in the forced consumption mode is shown in FIG. 10. As shown in FIG. 10, in the image formation of the "low-duty-black image chart", with respect to Y (yellow), M (magenta) and C (cyan), the print ratio is always sufficiently high and therefore a value to be added to the toner deterioration integrated value is the negative value.

On the other hand, with respect to K (black), the print ratio is low, and therefore the value to be added to the toner deterioration integrated value X is a positive value of +5. Accordingly, when the "low-duty-black image chart" is printed, the toner deterioration for K (black) goes little by little.

Further, in the image formation of the "high-duty-black", with respect to the Y (yellow), M (magenta) and C (cyan), the print ratio is sufficiently high, and therefore the value to be added to the toner deterioration integrated value X is the negative value. On the other hand, with respect to K (black), the print ratio is very high, and therefore the value to be added to the toner deterioration integrated value X is a negative value. On the other hand, with respect to K (black), the print ratio is very high, and therefore the value to be added to the toner deterioration integrated value X is a large negative value of −502. Accordingly, when the "high-duty-black image chart" is printed, the toner is abruptly recovered from the toner deterioration state for K (black).

As described above, progression in the case where the image of the "low-duty-black image chart" is formed on 104 sheets in the one-sheet intermittent mode and then the image of the "high-duty-black image chart" is formed newly on one sheet as described above (the case where the image is formed on 104 sheets in total at one surface of the A4-sized recording material) will be described. With respect to Y (yellow), M (magenta) and C (cyan), as shown in FIG. 10, the value added to the toner deterioration integrated value X is always the negative value. For this reason, as shown in the steps S5 and S6 in FIG. 8, the toner deterioration integrated value X is always in the state in which the toner deterioration integrated value X is reset to zero. For this reason, progression for K (black) will be described with reference to FIG. 11.

Figure 11:
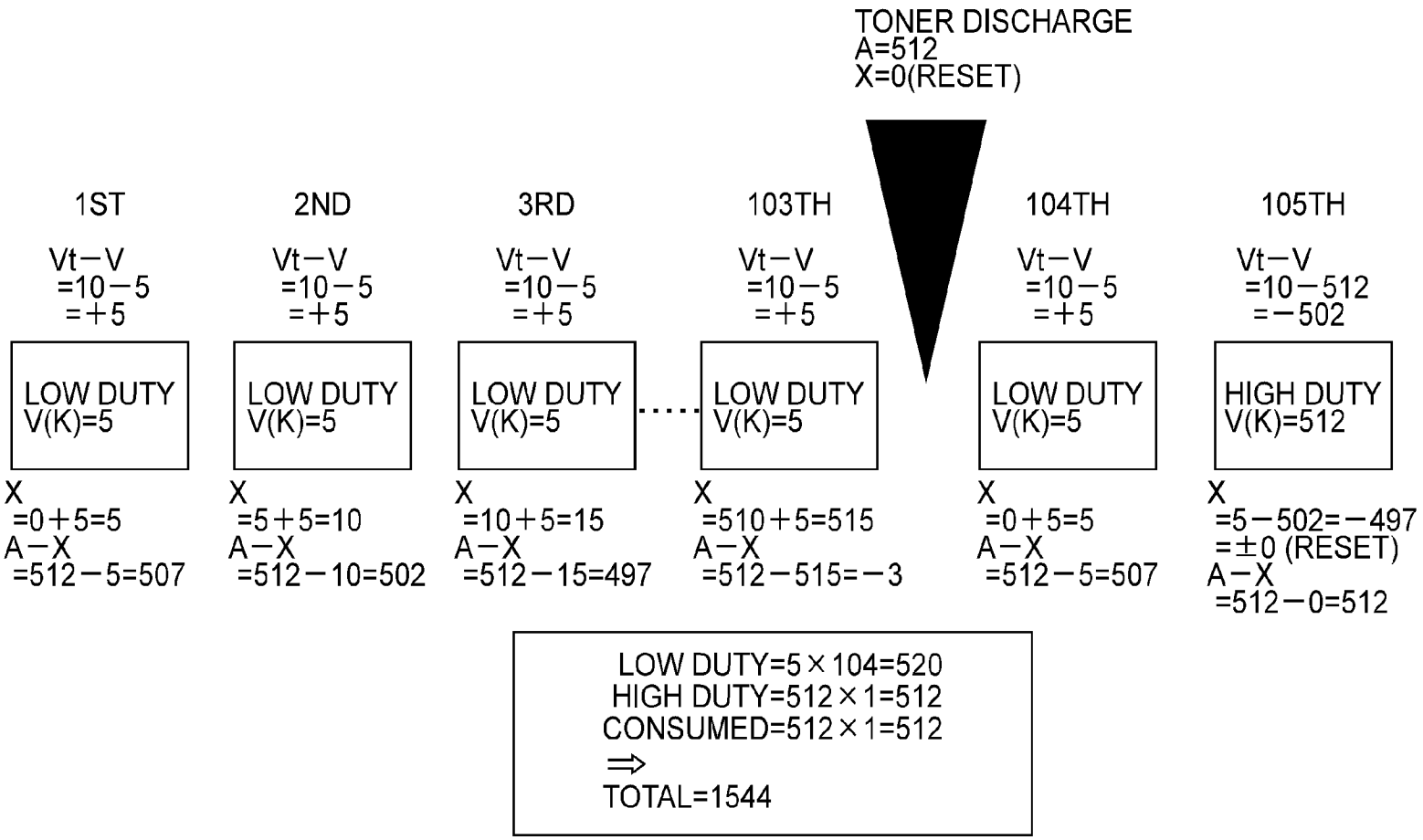
FIG. 11 is a schematic view showing a relationship among parameters in the case where an image of the low-duty-black is continuously formed in the Comparison Example.

As described above, during printing of the "low-duty-black image chart", the toner deterioration integrated value X is gradually integrated by +5. Accordingly, as shown in FIG. 11, from the first sheet to the 103-th sheet, the toner deterioration integrated value X is integrated and monotonically increased in the order of 5, 10, 15 . . . 515. Further, the value of the difference (A−X) between the toner discharge execution threshold A (=512) and the toner deterioration integrated value X is monotonically decreased, from the first sheet to the 102-th sheet in the order of 507, 502, 497 . . . 2, and at the 103-th sheet, the difference (A−X) is −3 which is the negative.

Figure 8:
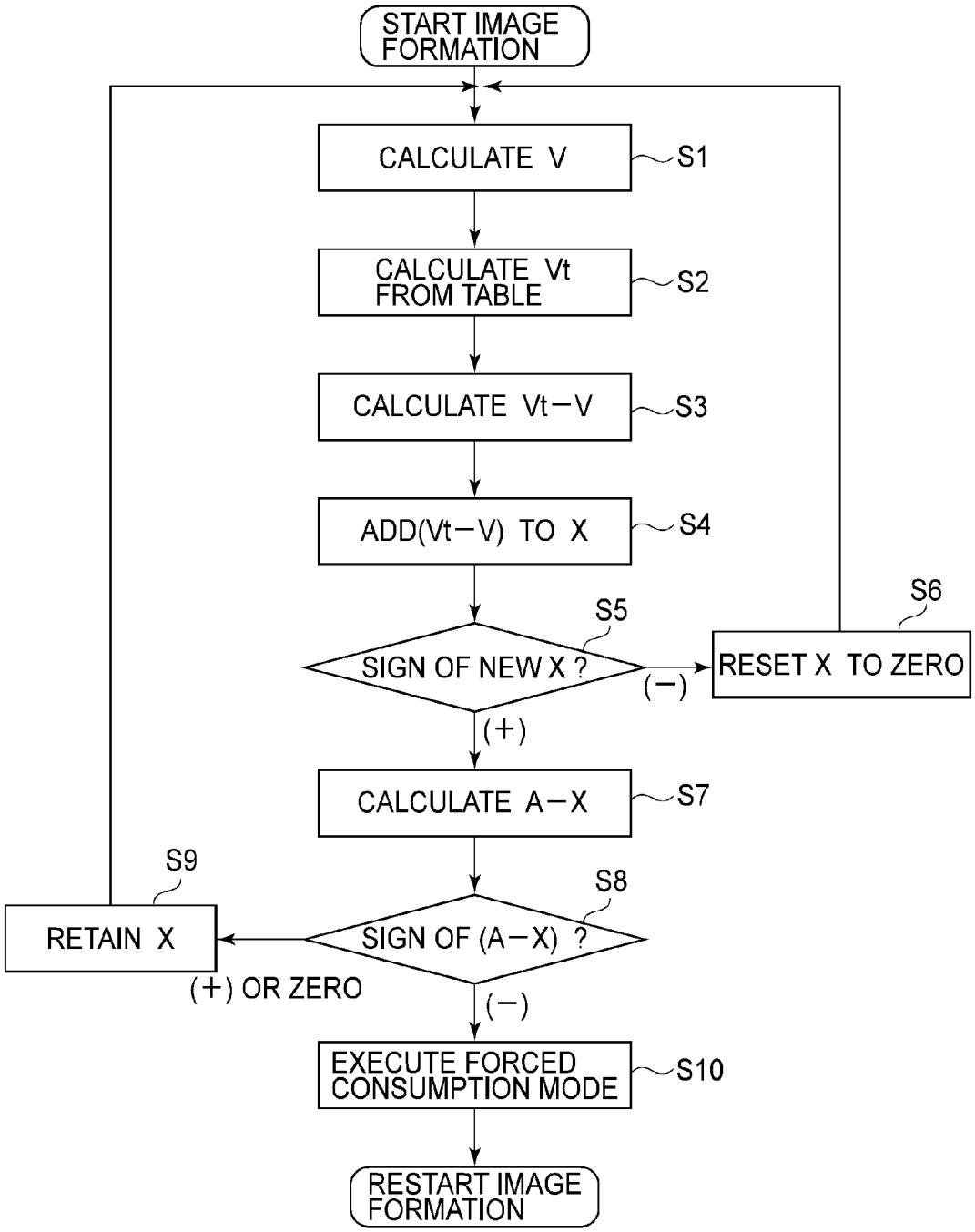
FIG. 8 is a flowchart for discriminating whether or not an operation in a forced consumption mode in the First Embodiment can be executed.
Figure 9:
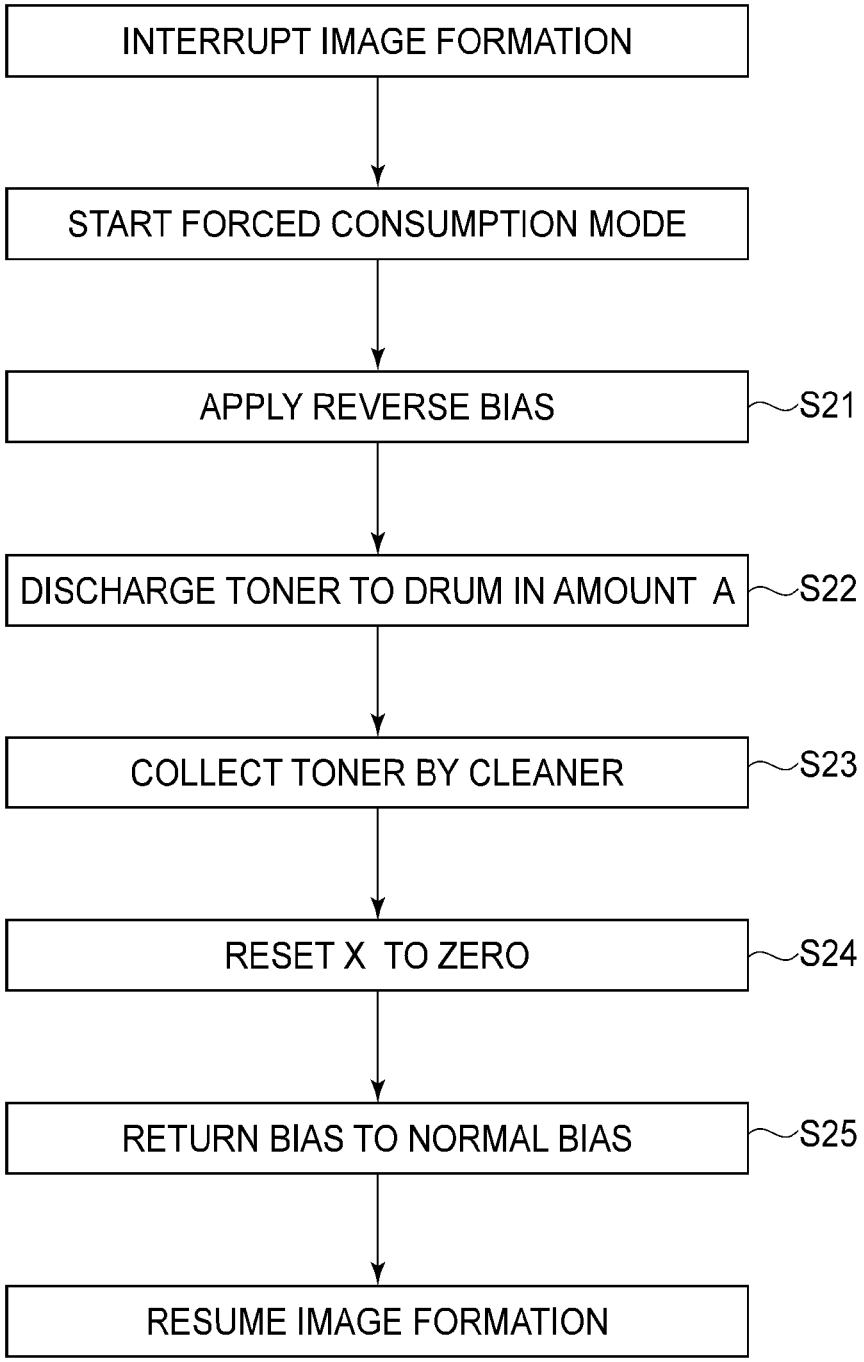
FIG. 9 is a flowchart showing an operation in the forced consumption mode in a Comparison Example.

In this case, in accordance with the flowcharts of FIGS. 8 and 9, the operation in the forced consumption mode is executed, so that the forced toner consumption in an amount corresponding to A=512 is executed (step S22 in FIG. 9).

Incidentally, in the Comparison Example, the image formation is effected in the one-sheet mode, and therefore the operation in the forced consumption mode is executed during post-rotation of an image forming job of the 103-th sheet. In the case where the image formation is not effected in the one-sheet intermittent mode but is effected continuously, the image formation is interrupted after the end of the image formation of the 103-th sheet, and then the operation in the forced consumption mode is executed. After the operation in the forced consumption mode is executed, the toner deterioration integrated value X is reset to zero (step S24 in FIG. 9). Then, when the "low-duty-black image chart" is printed on the 104-th sheet, the toner deterioration integrated value X is 5, so that the difference (A−X) is 507. Finally, when the "high-duty-black image chart" is printed on the 105-th sheet, as described above with reference to FIG. 10, −502 is added to the toner deterioration integrated value X, so that a new toner deterioration integrated value X is −497, and therefore the toner deterioration integrated value X is reset to zero (step S6 in FIG. 8).

From the above, with respect to K (black), a total toner consumption amount by the sheet passing of 105 sheets in the case where the operation in the forced consumption mode in the Comparison Example is performed will be estimated. Then, the respective video counts are 5×104=520 for 104 sheets of the "low-duty-black image chart", 512×1=512 for one sheet of the "high-duty-black image chart", and 512 for once of the forced toner consumption. As a result, in the operation in the Comparison Example, the toner in the amount corresponding to the video count of 1544 in total is consumed.

[Operation in Forced Consumption Mode in this Embodiment]

The operation in the forced consumption mode in this embodiment will be described with reference to FIG. 12. Also in the case of this embodiment, whether or not the operation in the forced consumption mode can be executed is discriminated in accordance with the flowchart of FIG. 8. In the case where the difference (A−X) is the negative value in the step S10 in FIG. 8 described above, the image formation is interrupted, and then the operation in the forced consumption mode is executed. First, to the primary transfer roller 105 (FIGS. 1 and 2), the primary transfer bias of the opposite polarity to that during the normal image formation (i.e., the transfer bias of the same polarity as the polarity of the toner image on the photosensitive drum 101) is applied (step S31). Then, the toner in an amount corresponding to a value (video count) obtained by multiplying the discharge execution threshold A by coefficient of less than 1 (0.5, i.e., 50% in this embodiment) is discharged (step S32). In other words, a part of the toner in an amount corresponding to the toner deterioration integrated value X is consumed. In this embodiment, the discharge execution threshold A is set at 512 (corresponding to the video count of the image having the whole surface solid image print ratio of 100% on one surface of the A4-sized recording material). For this reason, an operation in which a solid image having a length of 50% with respect to a sub-scanning direction (rotational direction of the photosensitive drum 101) on one surface of the A4-sized recording material is discharged onto the photosensitive drum 101, i.e., the operation in the forced consumption mode is executed so as to consume the toner in an amount corresponding to A×0.5

Then, the toner discharged on the photosensitive drum 101 is not transferred onto the intermediary transfer belt and is collected by the cleaner 109 since the primary transfer bias has the same polarity as the polarity of the toner (step S33). The toner deterioration integrated value X is reset to a value of (X−(A×0.5)) (step S34). That is, the CPU 206 resets, depending on execution of the operation in the forced consumption mode, the integrated value (the integrated value X) to a predetermined positive value smaller than the predetermined threshold (the discharge execution threshold A). Further, in the case where the operation in the forced consumption mode is executed, a value obtained by subtracting, from the toner deterioration integrated value X at that time, a value obtained by multiplying the discharge threshold A by the above-described coefficient (0.5) is used as the reset value (X−(A×0.5)). Finally, the primary transfer bias is returned to the transfer bias of the polarity during the normal image formation (step S35), and then the operation in the forced consumption mode is ended and the operation is restored to the normal image forming operation. After the restoration (after the execution of the operation in the forced consumption mode), in accordance with the flowchart of FIG. 8, the difference (Vt−V) is added (integrated) to the reset value of (X−(A×0.5)) (step S4 in FIG. 8).

As described above, in the operation in the forced consumption mode in this embodiment, the toner deterioration integrated value X is not reset to zero after the execution of once of the operation in the forced consumption mode. That is, in the Comparison Example described above, the toner in an amount corresponding to the solid image on one surface of the A4-sized recording material is refreshed by the execution of the operation in the forced consumption mode, and also the toner deterioration integrated value X is reset to zero. However, in this embodiment, the toner in an amount corresponding to 50% of the solid image on one surface of the A4-sized recording material is refreshed by the operation in the forced consumption mode, and also the toner deterioration integrated value X is reset only by about 50%. That is, the operation in the forced consumption mode is executed so as to leave a toner deterioration state at a predetermined level of a level capable of maintaining an image quality, without completely resetting the toner deterioration state.

[Specific Example of Operation in Forced Consumption Mode in this Embodiment]

Also in the operation in the forced consumption mode in this embodiment described above, similarly as in the Comparison Example, the progression of the case where the image of the "low-duty-black image chart" is formed on 104 sheets in the one-state intermittent mode and then the image of the "high-duty-black image chart" is formed newly on one sheet will be described. Incidentally, how to integrate the toner deterioration integrated value X for each of the colors in the case where each of the images of the "low-duty-black image chart" and the "high-duty-black image chart" is formed on one sheet on one surface of the A4-sized recording material is the same as that described above with reference to the table of FIG. 10. Further, with respect to Y (yellow), M (magenta) and C (cyan), as shown in FIG. 10, the value added to the toner deterioration integrated value X is always the negative value. For this reason, as shown in the steps S5 and S6 in FIG. 8, the toner deterioration integrated value X is always in the state in which the toner deterioration integrated value X is reset to zero. For this reason, progression for K (black) will be described with reference to FIG. 13.

Figure 13:
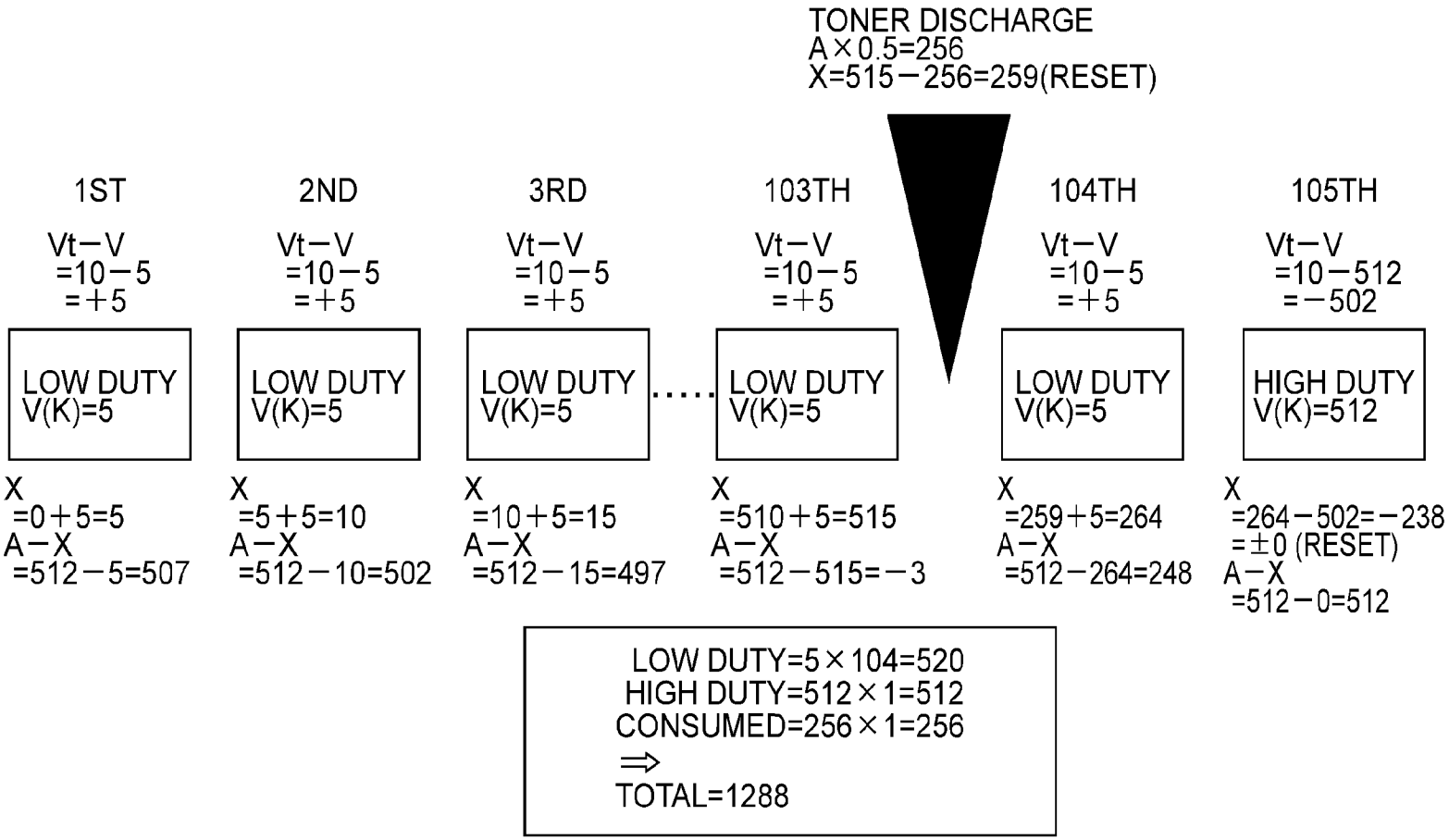
FIG. 13 is a schematic view showing a relationship among parameters in the case where the image of the low-duty-black is continuously formed in the First Embodiment.

As described above with reference to FIG. 10, during printing of the "low-duty-black image chart", the toner deterioration integrated value X is gradually integrated by +5. Accordingly, as shown in FIG. 13, from the first sheet to the 103-th sheet, the toner deterioration integrated value X is integrated and monotonically increased in the order of 5, 10, 15 . . . 515. Further, the value of the difference (A−X) between the toner discharge execution threshold A (=512) and the toner deterioration integrated value X is monotonically decreased, from the first sheet to the 102-th sheet in the order of 507, 502, 497 . . . 2, and at the 103-th sheet, the difference (A−X) is −3 which is the negative.

Figure 12:
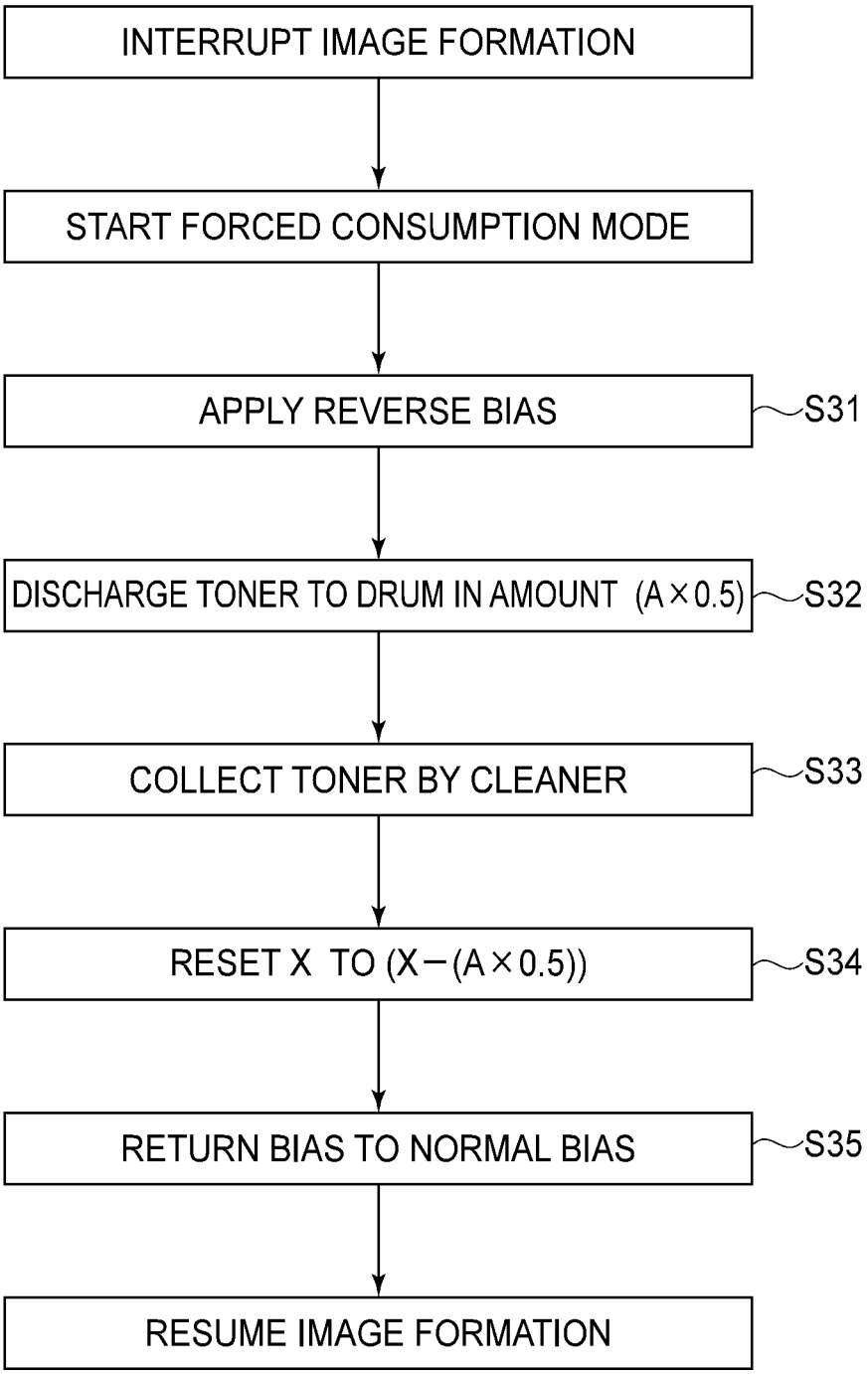
FIG. 12 is a flowchart showing an operation in the forced consumption mode in the First Embodiment.

In this case, in accordance with the flowcharts of FIGS. 8 and 12, the operation in the forced consumption mode is executed, so that the forced toner consumption in an amount corresponding to A×0.5=256 is executed (step S32 in FIG. 12). Incidentally, also in this embodiment, the image formation is effected in the one-sheet mode, and therefore the operation in the forced consumption mode is executed during post-rotation of an image forming job of the 103-th sheet. In the case where the image formation is not effected in the one-sheet intermittent mode but is effected continuously, the image formation is interrupted after the end of the image formation of the 103-th sheet, and then the operation in the forced consumption mode is executed. After the operation in the forced consumption mode is executed, the toner deterioration integrated value X is reset to (X−(A×0.5))=515−256=259 (step S34 in FIG. 12). Then, when the "low-duty-black image chart" is printed on the 104-th sheet, the toner deterioration integrated value X is 264, so that the difference (A−X) is 248. Finally, when the "high-duty-black image chart" is printed on the 105-th sheet, as described above with reference to FIG. 10, −502 is added to the toner deterioration integrated value X, so that a new toner deterioration integrated value X is −238, and therefore the toner deterioration integrated value X is reset to zero (step S6 in FIG. 8).

From the above, with respect to K (black), a total toner consumption amount by the sheet passing of 105 sheets in the case where the operation in the forced consumption mode in this embodiment is performed will be estimated. Then, the respective video counts are 5×104=520 for 104 sheets of the "low-duty-black image chart", 512×1=512 for one sheet of the "high-duty-black image chart", and 256 for once of the forced toner consumption. As a result, in the operation in the Comparison Example, the toner in the amount corresponding to the video count of 1288 in total is consumed.

[Comparison Between this Embodiment and Comparison Example]

As described above, in the Comparison Example, in the case where the image of the "low-duty-black image chart" is formed on 104 sheets and then the image of the "high-duty-black image chart" is formed newly on one sheet, the toner in the amount corresponding to the video count of 1544 in total is consumed. On the other hand, in the case of this embodiment, as described above, the toner in the amount corresponding to the video count of 1288 in total is consumed. Accordingly, in the case of this embodiment, compared with the Comparison Example, the toner consumption amount can be suppressed by about 16.6%.

Further, also with respect to the image quality, in this embodiment, a maximum of the toner deterioration integrated value X is 515, so that a level equivalent to the level in the Comparison Example. Further, with respect to the downtime, the number of control of the operation in the forced consumption mode is one in both of the Comparison Example and this embodiment, but in the control in this embodiment, the length of the toner discharge image with respect to the sub-scanning direction is about 50%, and therefore a control time of a single operation can be reduced. Accordingly, also a downtime reducing effect of about 1 second is obtained.

The toner consumption amount reducing effect varies depending on a constitution of the print job (such as one-job sheet number, the number of sheets sin the intermittent mode, sheet size, image duty, or one surface/double surface), and the downtime reducing effect varies also depending on the constitution of the print job and a process speed of the image forming apparatus. Incidentally, the one-job sheet number is the number of sheets subjected to image formation in one image forming job. Accordingly, in the above, the description is made using an easy-to-understand example of the effect of the present invention. Further, in this embodiment, the control constitution in which the toner in the amount corresponding to 50% (coefficient) of the toner discharge execution threshold A is forcedly consumed was described, but the effect of the present invention is not limited to that in the case where the coefficient is 50%. However, in order to suitably achieve the effect of the present invention, it is desirable that the coefficient is set in a range of 0.3-0.7, i.e., 30%-70%.

The example in which the "high-duty-black image chart" is printed on the 105-th sheet was described above with reference to FIG. 13, but the case where the images having the same image ratio are continuously formed (printed) will be considered. Specifically, the case where the image having the image ratio corresponding to a predetermined ratio or less is continuously formed will be considered. The predetermined ratio or less is set, at 10% or less, 5% or less, 1% or less, or the like in terms of the print ratio, depending on the kind of the image forming apparatus. In the case where if an average image ratio is the same (condition), e.g., in the case where the "low-duty-black image chart" is continuously printed, similarly as in FIG. 13, the operation in the forced consumption mode is executed after the image formation of the 103-th sheet. In this case, in this embodiment, the toner deterioration integrated value X is reset to (X−(A×0.5)). For this reason, thereafter when the "low-duty-black image chart" is continuously printed, the operation in the forced consumption mode is executed at timing earlier than the case where the toner deterioration integrated value X is zero.

That is, the operation in the forced consumption mode is executed so that the number of sheets subjected to image formation from execution of the operation in the forced consumption mode to subsequent of the operation in the forced consumption mode is smaller than the number of sheets subjected to image formation from the time when the toner deterioration integrated value X is zero to first execution of the operation in the forced consumption mode. In other words, an interval until the operation in the forced consumption mode is executed is shorter, than in an interval from the time when the predetermined condition is satisfied (i.e., the timing when the toner deterioration integrated value X is zero) to the first execution of the operation in the forced consumption mode, in subsequent intervals. However, with respect to the amount of the toner consumed in the operation in the forced consumption modem, the amount corresponds to A×0.5, so that the amount of the toner consumed in one operation in the forced consumption mode is smaller than that in the case where the toner in the amount corresponding to A is consumed as in the Comparison Example. For this reason, in the case where the images having the same image ratio are continuously formed in both of this embodiment and the Comparison Example, the amount of the toner consumed is substantially the same.

From the above, in the case of this embodiment, a condition for executing the operation in the forced consumption mode is made different between the interval from the timing when the predetermined condition is satisfied to the first execution of the operation in the forced consumption mode and the subsequent intervals. The predetermined condition is the case where the use of the developing device is started from the unused state or the case where the toner deterioration integrated value X satisfies a predetermined reset condition by forming the image having a high image ratio as in the step S6 in FIG. 8. The predetermined reset condition is, in this embodiment, such that the toner deterioration integrated value X is the negative value in the step S5 in FIG. 8, and in this case, the toner deterioration X is reset to zero in the step of S6. Further, in the case where the use of the developing device is started from the unused state, as described above, the toner deterioration integrated value X is zero. For this reason, in this embodiment, the timing when the predetermined condition is satisfied is time when the toner deterioration integrated value X is zero.

Further, in the case of this embodiment, when the toner deterioration integrated value X is larger than the discharge execution threshold A (predetermined threshold), the toner deterioration integrated value X is made different, by executing the operation in the forced consumption mode, from a value in the case where the use of the developing device is started from the unused state. That is, the toner deterioration integrated value X in the case where the use of the developing device is started from the unused state is zero, whereas the toner deterioration integrated value X in the case where the operation in the forced consumption mode is executed is (X−(A×0.5)).

As described above, in the case of this embodiment, in the operation in the forced consumption mode, the toner in the amount corresponding to the value (A×0.5) obtained by multiplying the discharge execution threshold A by the coefficient (0.5) of less than 1 is consumed. In other words, when the operation in the forced consumption mode is executed, the discharge of the toner in the amount corresponding to a part of a toner deterioration index (discharge execution threshold A) is executed. For this reason, the toner consumption amount in the operation in the forced consumption mode can be suppressed. Further, as described above, even when the toner consumption amount in the operation in the forced consumption mode is small, thereafter if the image having the high image ratio is formed, the toner deterioration state is eliminated as described above with reference to FIG. 3. That is, in the case of this embodiment, in consideration of the case where the image having the high image ratio is formed after the operation in the forced consumption mode is consumed, the amount of the toner consumed in the operation in the forced consumption mode is suppressed. Accordingly, thereafter when the image having the high image ratio is formed and the toner deterioration state is eliminated, even if the amount of the toner consumed in the operation in the forced consumption mode is small, it is possible to suppress generation image defect due to the toner deterioration. In addition, the toner consumption amount as a whole can be suppressed corresponding to a decrease in amount of the toner consumed in the operation in the forced consumption mode.

Further, the reset value of the toner deterioration integrated value X is the value (X−(A×0.5)) obtained by subtracting, from the toner deterioration X, the value obtained by multiplying the discharge execution threshold A by the coefficient (0.5). In other words, in synchronism with the toner discharging operation, the toner deterioration index is restored partly. For this reason, thereafter even when the image having the high image ratio is not formed, the operation in the forced consumption mode is executed at appropriate timing such that the toner deterioration adversely affects the image. For example, the operation in the forced consumption mode is executed in a stage earlier than the case where the toner deterioration integrated value X is reset to zero. Further, also even in the operation in the forced consumption mode in this case, the toner consumption amount is similarly suppressed, and therefore the toner consumption amount is made equivalent to that in the case where the reset value of the toner deterioration integrated value X is zero. As a result, in the cases of this embodiment, the toner consumption amount can be suppressed while appropriately eliminating the toner deterioration.

<Second Embodiment>

A Second Embodiment of the present invention will be described with reference to FIGS. 14 and 15. In the First Embodiment described above, the control in which the coefficient by which the toner discharge execution threshold A is multiplied is 0.5 (50%) and the toner in the amount corresponding to 50% of A is discharged in the operation in the forced consumption mode was described. On the other hand, in this embodiment, this coefficient Z is changed depending on an average image ratio (average print ratio). Other constitution and actions (functions) are similar to those in the First Embodiment, and therefore redundant description and illustration will be omitted or simplified, and in the following, a portion different from the First Embodiment will be principally described.

First, an important point of the present invention is such that the amount of the toner consumed in the operation in the forced consumption mode is suppressed and the toner deterioration is suppressed by effectively using the high-duty image chart (image having the high image ratio) having a possibility of formation in the future. Accordingly, e.g., if the possibility of the formation of the high-duty image is high, there is a high possibility that the total toner consumption amount can be suppressed when the toner in a smaller amount is forcedly consumed with respect to the toner discharge execution threshold A. For this reason, in this embodiment, a flow of the operation in the forced consumption mode is changed depending on an average video count (value corresponding to the average image ratio) of a predetermined number of sheets subjected to image formation (the last 1000 sheets in this embodiment).

The flow of the operation in the forced consumption mode in this embodiment will be described with reference to FIG. 14. Also in the case of this embodiment, similarly as in the First Embodiment, in the above-described step S10 of FIG. 8, in the case where the difference (A−X) is the negative value, the image formation is interrupted and then the operation in the forced consumption mode is executed in accordance with a flowchart of FIG. 14. First, to the primary transfer roller 105, a primary transfer bias of an opposite polarity to that during the normal image formation (i.e., the transfer bias of an identical polarity to the charge polarity of the toner image on the photosensitive drum 101) is applied (step S41).

Next, as a new flow step, a forced consumption amount coefficient Z which is the coefficient of less than 1 is determined depending on the average video count of the last 1000 sheets (step S42). The forced consumption amount coefficient Z is calculated from a table of FIG. 15, and is a value determined depending on the average video count of the last 1000 sheets stored in RAM 211 (FIG. 3) as a video count storing portion. That is, the CPU 206 also as an image ratio calculating means reads the video count of the predetermined number of sheets (1000 sheets), subjected to image formation, stored in the RAM 211. Then, the CPU 206 calculates the average video count corresponding to the average image ratio, which is the image ratio per predetermined unit (one A4-sized sheet), with respect to the predetermined number of sheets (1000 sheets) subjected to image formation. Then, the CPU 206 determines the forced consumption amount coefficient Z corresponding to the calculated average video count by making reference to the table of FIG. 15 stored in the RAM 211. For example, in the case where the average print ratio (average image ratio) of the last 1000 sheets is 20%, the average video count is 102, so that the forced consumption amount coefficient Z is 30%.

Next, with respect to the discharge execution threshold A, the toner in an amount corresponding to the video count of A×X is discharged onto the photosensitive drum 101 (step S43). In this embodiment, the discharge execution threshold A is set at 512 (corresponding to the video count of the image having the whole surface solid image print ratio of 100% on one surface of the A4-sized recording material). For this reason, Z=0.3 (30%) in the case where the average video count of the last 1000 sheets is e.g., 102. Accordingly, an operation in which a solid image having a length of 30% with respect to the sub-scanning direction on one surface of the A4-sized recording material is discharged onto the photosensitive drum 101, i.e., the operation in the forced consumption mode is executed so as to consume the toner in an amount corresponding to A×0.3.

In this way, in the case where the average print ratio is high, also in the future, there is a high possibility of the formation of the image having the high print ratio. For this reason, in this embodiment, the CPU 206 makes the forced consumption amount coefficient Z larger in the case where the average image ratio is a second ratio smaller than a first ratio, than in the case where the average image ratio is the first ratio. That is, in the case where the average video count corresponding to the average image ratio is large (the first ratio), there is a high possibility of formation of the image having the high print ratio in the future, and therefore the forced consumption amount coefficient Z is made small in the expectation that the toner deterioration is eliminated by the image having the high print ratio. As a result, the amount of the toner consumed in the operation in the forced consumption mode can be made small. On the other hand, in the case where the average video count is the second ratio smaller than the first ratio, there is a low possibility of formation of the image having the high print ratio in the future, and therefore also a possibility that the toner deterioration is eliminated by this image having the high print ratio is low. For this reason, by increasing the forced consumption amount coefficient E, the toner deterioration is eliminated to the possible extent by the operation in the forced consumption mode.

Then, the toner discharged on the photosensitive drum 101 is not transferred onto the intermediary transfer belt and is collected by the cleaner 109 since the primary transfer bias has the same polarity as the polarity of the toner (step S44). The toner deterioration integrated value X is reset to a value of (X−(A×Z)) (step S45). That is, in the case where the operation in the forced consumption mode is executed, a value obtained by subtracting, from the toner deterioration integrated value X at that time, a value obtained by multiplying the discharge threshold A by the above-described coefficient (Z) is set by the CPU 206 as the reset value (X−(A×Z)). Finally, the primary transfer bias is returned to the transfer bias of the polarity during the normal image formation (step S46), and then the operation in the forced consumption mode is ended and the operation is restored to the normal image forming operation. After the restoration (after the execution of the operation in the forced consumption mode), in accordance with the flowchart of FIG. 8, the difference (Vt−V) is added (integrated) to the reset value of (X−(A×Z)) (step S4 in FIG. 8).

As described above, in this embodiment, compared with the control in the First Embodiment, in the case where a probability of the high print ratio is high on the basis of the average video count of the last 1000 sheets, suppression of the total toner consumption amount is realized by reducing the toner consumption amount in the operation in the forced consumption mode.

A specific effect in this embodiment will be considered with reference to, e.g., FIG. 13 in the First Embodiment. At the time of the 103-th sheet in FIG. 13, the case where the average video count of the last 1000 sheets is 102 will be considered. For example, the case where the image of a sheet before the first sheet in FIG. 13 has the high print ratio or in the like case corresponds to this case. Further, until the difference (Z−X) is the negative value of −3 at the 103-th sheet, the operation is similar to the operation in the First Embodiment.

Figure 14:
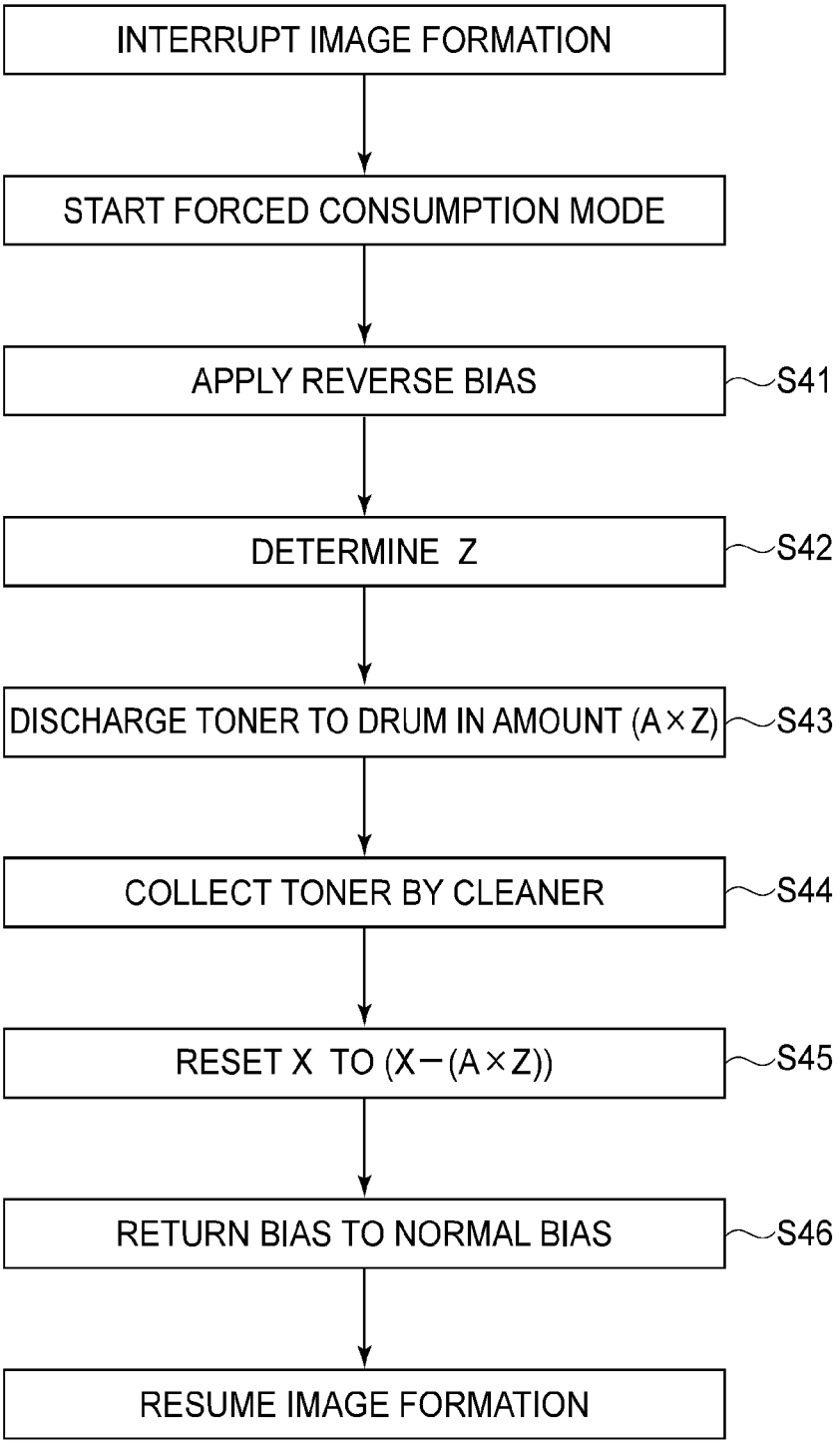
FIG. 14 is a flowchart showing an operation in the forced consumption mode in a Second Embodiment.

In this case, in accordance with the flowcharts of FIGS. 8 and 14, the operation in the forced consumption mode is executed, so that the forced toner consumption in an amount corresponding to A×0.3=154 is executed in accordance with a calculation table of the forced consumption amount coefficient Z in FIG. 15 (step S43 in FIG. 14). Then, the toner deterioration integrated value X is reset to (X−(A×0.3)) =515=154=361 (step S45 in FIG. 14). Then, when the "low-duty-black image chart" is printed on the 104-th sheet, the toner deterioration integrated value X is 366, so that the difference (A−X) is 146. Finally, when the "high-duty-black image chart" is printed on the 105-th sheet, as described above with reference to FIG. 10, −502 is added to the toner deterioration integrated value X, so that a new toner deterioration integrated value X is −136, and therefore the toner deterioration integrated value X is reset to zero (step S6 in FIG. 8).

From the above, with respect to K (black), a total toner consumption amount by the sheet passing of 105 sheets in the case where the operation in the forced consumption mode in this embodiment is performed will be estimated. Then, the respective video counts are 5×104=520 for 104 sheets of the "low-duty-black image chart", 512×1=512 for one sheet of the "high-duty-black image chart", and 154 for once of the forced toner consumption. As a result, in the operation in the Comparison Example, the toner in the amount corresponding to the video count of 1186 in total is consumed.

In the First Embodiment, the toner in the amount corresponding to the video count of 1288 in total is consumed, and in this embodiment, the toner in the amount corresponding to the video count of 1186 in total is consumed. For this reason, in this embodiment, compared with First Embodiment, the toner consumption amount can be further suppressed by about 7.9%.

Further, also with respect to the image quality, in this embodiment, also a maximum of the toner deterioration integrated value X is 515, so that a level equivalent to the levels in the Comparison Example and the First Embodiment. Further, with respect to the downtime, the number of control of the operation in the forced consumption mode is one in all of the Comparison Example, the First Embodiment and this embodiment. However, in this embodiment, the length of the toner discharge image with respect to the sub-scanning direction is about 50%, and therefore a control time of a single operation can be further reduced. Compared with the Comparison Example, also a downtime reducing effect of about 1.4 seconds is obtained.

<Third Embodiment>

Figure 16:
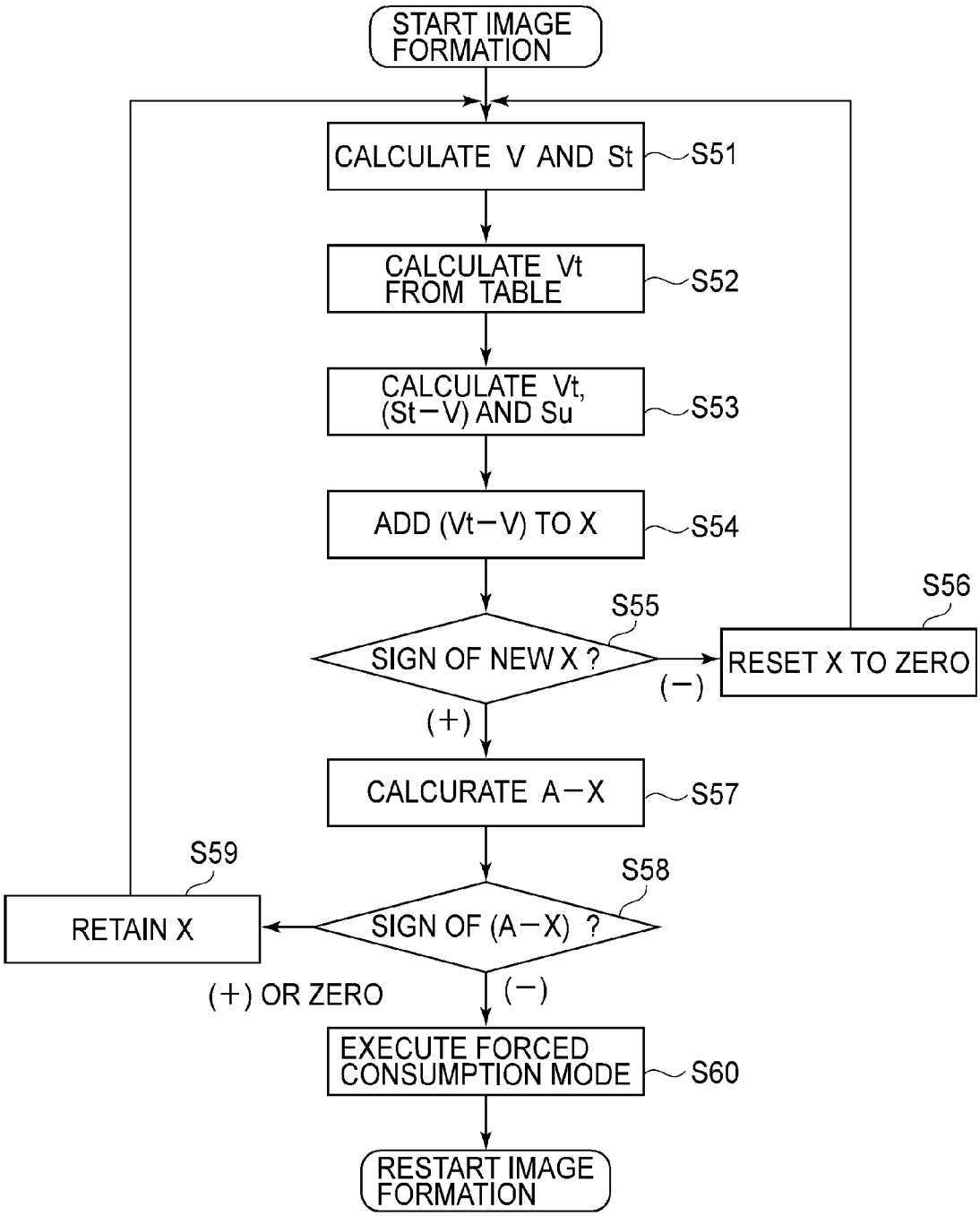
FIG. 16 is a flowchart for discriminating whether or not an operation in a forced consumption mode in a third Embodiment can be executed.

A Third Embodiment of the present invention will be described with reference to FIG. 16. In the First and Second Embodiments described above, as shown in FIG. 8, (Vt−V) was calculated while fixing the toner deterioration threshold video count Vt as the reference value and was then integrated, and thus whether or not the operation in the forced consumption mode was able to be executed was discriminated. On the other hand, in this embodiment, a driving time of the developing device every image formation of one sheet is calculated, and then the reference value is changed depending on the driving time. That is, in this embodiment, the reference value is a value obtained by multiplying the toner deterioration threshold video count Vt as a fixed value by a variable state depending on the driving time. Other constitutions and actions (functions) are similar to those in First Embodiment and the Second Embodiment, and therefore redundant description and illustration will be omitted or simplified, and in the following, a portion different from the First Embodiment and the Second Embodiment will be principally described.

First, when the present inventors specifically study a toner deterioration mechanism, it turned out that the toner deterioration depends on the developing device driving time (a driving time of the developing sleeve 24 or a driving time of the first and second feeding screws 22*a* and 22*b*). Therefore, in this embodiment, the operation in the forced consumption mode is executed depending on the driving time of the developing sleeve 24 and the video count.

The values of the toner deterioration threshold video count Vt shown in FIG. 7 described above are empirically investigated thresholds at which the image defect generates. A total developing sleeve driving time at this time was about 2000 seconds. Accordingly, for, e.g., Y (yellow), when replacement of the toner is generated by supply of the toner having the print ratio of 1%=video count of 5 with respect to the toner deterioration due to the developing sleeve driving time of 2 seconds, this means that the generation of the image defect can be suppressed. In the case of continuous image formation, there is no control of pre-rotation and post-rotation in image formation of one sheet other than image formation of the first sheet and image formation of the last sheet, and therefore in the image forming apparatus in this embodiment, the developing sleeve driving time of image formation of one sheet (i.e., reference time Su) is 2 seconds. However, the reference time Su which is the developing sleeve driving time per (one) sheet in the continuous image formation is a value determined depending on a performance of the image forming apparatus and varies depending on the kind of the image forming apparatus.

Based on such a premise, discrimination as to whether or not the operation in the forced consumption mode can be executed will be described. As a precondition, a concept of the operation in the forced consumption mode for each of the colors is the same similarly as in the case of FIG. 3 described above. Therefore, the colors are omitted from description in the following flow-charts and the like in some cases, but in those cases, common control is effected for each of the colors. In this embodiment, as an easy-to-understand example, the case where such an image that the print ratios per (one) sheet for the colors of Y, M, C and K are 5% for Y, 5% for M, 5% for C and 1% for K ("low-duty-black image chart") is formed on A4-sized sheets in one-sheet intermittent manner is considered.

When the image formation is started, the video signal count portion 207 calculates, as described above with reference to FIG. 3, video counts V(K), V(M), V(C) and V(K) for the respective colors. Further, the CPU 206 (FIG. 3) also as a driving time calculating means calculates the developing sleeve driving time St (sec) (step S51). In this embodiment, the video count of the whole (entire) surface solid image (the image with the print ratio of 100%) on one surface (side) of A4-sized sheet for a certain color is 512. The video counts of the "low-duty-black image chart" are V(Y)=26, V(M)=26, V(C)=26 and V(K)=15. Here, when each video count is calculated, the fractional portion of the number is rounded off to the nearest integer.

Further, the developing sleeve driving time St is 2 seconds as described above in the case of one sheet other than the first sheet and the last sheet in the continuous image formation. In the case of the first sheet, a pre-rotation time is added thereto, and in the case of the last sheet, a post-rotation time is added thereto. Incidentally, in the case where the image formation is interrupted by effecting control other than the operation in the forced consumption mode during the image formation but the developing sleeve is driven, a time thereof may also be added to the developing sleeve driving time in image formation of one sheet at that time. In this embodiment, the image is formed in the one-sheet intermittent manner, and therefore the developing sleeve driving time is 2.5 seconds (St=2.5 sec.) per (one) sheet. St corresponds to a unit driving time of the developing device (developing sleeve 24).

Then, the toner deterioration threshold video count Vt is calculated from the table (FIG. 17) of the toner deterioration threshold video count Vt obtained by the above-described experiment or the like (step S52). From FIG. 7, the toner deterioration threshold video count Vt for Y and C is 5, and the toner deterioration threshold video count Vt for M and K is 10. The toner deterioration threshold video count Vt is appropriately set depending on the above-described reference time Su. That is, as described above, the reference time Su is determined depending on the kind of the image forming apparatus, and if the reference time is long, also a degree of the toner deterioration per image formation of one sheet varies. For this reason, Vt may preferably be set depending on Su. In this embodiment, the kind of the image forming apparatus is such that Su is 2 sec., and therefore Vt is set as described above.

Then, (Vt×St)−(V×Su) is calculated from the video count V, the toner deterioration threshold video count Vt, the developing sleeve driving St and the reference time Su (step S53). In this embodiment, St is 2.5 sec., and the Su is 2 sec., and therefore (Vt×St)−(V×Su) is (Vt×2.5)−(V×2). That is, the CPU 206 calculates the difference ((Vt×2.5)−(V×2)) by subtracting (V×2) (consumed value) from (Vt×2.5). Further, irrespective of the sign (positive or negative) of the value of (Vt×St)−(V×Su), ((Vt×St)−(V×Su)) is added to the toner deterioration integrated value X (step S54).

When the step S54 is specifically described, e.g., in the case where the print ratio is low, the value of V is small, so that the value of (Vt×St)−(V×Su) is a positive value. Further, the value of (Vt×St)−(V×Su) can be the positive value also in the case where the developing sleeve driving time St becomes long by performing, e.g., an operation such as the pre-rotation or the post-rotation in the continuous image formation. By adding the above-calculated positive value of (Vt−V) to the toner deterioration integrated value X, the resultant value represents a state in which the toner deterioration goes. On the other hand, e.g., in the case where the print ratio is high, the value of V is large, so that the value of (Vt−V) is a negative value. By adding the above-calculated negative value of (Vt−V) to the toner deterioration integrated value X, the resultant value represents a state in which the toner is recovered from the toner deterioration state. Here, when ((Vt×St)−(V×Su)) is divided by (St×Su), (Vt/Su)−(V/St) is obtained. In this case, (Vt/Su) is a fixed value, and (V/St) is information about the consumption amount of the toner consumed per unit driving time of the developing device. Further, when this information (V/St) is less than a predetermined value, i.e., is less than (Vt/Su), ((Vt/Su)−(V/St)) becomes a positive value and shows that the toner deterioration goes. Further, deterioration information determined on the basis of the information (V/St) and the predetermined value (Vt/Su) corresponds to ((Vt×St)−(V×Su)).

Then, the CPU 206 discriminates the sign (positive or negative) of the latest toner deterioration integrated value X calculated in the step S54 (step S55). Then, in the case where the toner deterioration integrated value X is a negative value, the toner deterioration integrated value X is reset to zero (step S56). That is, in this case, a state in which the toner deterioration is reset by the consumption of the high print ratio toner and then by supply of the (new) toner is formed. Accordingly, the toner deterioration integrated value X is reset to zero, and subsequently image formation is executed (returned to step S51).

On the other hand, in the case where the toner deterioration integrated value X is a positive value.

With respect to the toner deterioration integrated value X calculated and updated every image formation in the above steps, the CPU 206 calculates the difference (A−X) of the toner deterioration integrated value X from the discharge execution threshold A is (step S57).

Steps S58-S60 are similar to the steps S8-S10 in FIG. 8. As a flow of the operation in the forced consumption mode in the step of S60, the operation in the forced consumption mode as in the First Embodiment (FIG. 12) or the Second Embodiment (FIG. 14) is executed. As a result, it is possible to provide an image forming apparatus capable of satisfactorily maintaining the image quality by preventing the toner deterioration while minimizing the toner consumption amount in the operation in the forced consumption mode.

Further, in this embodiment, the value of the toner deterioration integrated value X is determined in consideration of the developing sleeve driving time St. That is, (Vt×St) is used as the reference value for obtaining the toner deterioration integrated value X, so that the developing sleeve driving time St is reflected in the toner deterioration integrated value X. In order to reflect St in the reference value, the video count V is multiplied by the reference time Su. As a result, the toner deterioration integrated value X further following the toner deterioration can be calculated, so that the toner deterioration can be prevented more appropriately.

In this embodiment as described above, the case where the image for which the information about the consumption amount of the toner consumed per unit driving time of the developing device is not more than a predetermined value will be considered. Specifically, the case where the information (V/St) is less than (Vt/Su) will be considered. In the case where if an average image ratio is the same (condition) (i.e., the information is the same (condition)), e.g., in the case where the "low-duty-black image chart" is continuously printed, similarly as in FIG. 13, the operation in the forced consumption mode is executed after the image formation of the 103-th sheet. In this case, in this embodiment, the toner deterioration integrated value X is reset to (X−(A×0.5 or Z)). For this reason, thereafter when the "low-duty-black image chart" is continuously printed, the operation in the forced consumption mode is executed at a time earlier than the case where the toner deterioration integrated value X is zero.

That is, the operation in the forced consumption mode is executed so that the number of sheets subjected to image formation from execution of the operation in the forced consumption mode to subsequent of the operation in the forced consumption mode is smaller than the number of sheets subjected to image formation from the timing when the toner deterioration integrated value X is zero to first execution of the operation in the forced consumption mode. In other words, an interval until the operation in the forced consumption mode is executed is shorter, than in an interval from the timing when the predetermined condition is satisfied (i.e., the timing when the toner deterioration integrated value X is zero) to the first execution of the operation in the forced consumption mode, in subsequent intervals. However, with respect to the amount of the toner consumed in the operation in the forced consumption modem, the amount corresponds to A×0.5 or Z, so that the amount of the toner consumed in one operation in the forced consumption mode is smaller than that in the case where the toner in the amount corresponding to A is consumed as in the Comparison Example described above. For this reason, in the case where the images having the same image ratio are continuously formed in both of this embodiment and the Comparison Example, the amount of the toner consumed is substantially the same.

In the description in the above-described embodiments, the video count is used as the consumption amount depending on the amount of the toner consumed every predetermined unit of image formation and as the reference value set for the predetermined unit, but the present invention is not limited thereto. That is, the amount of the toner consumed with the image formation may only be required to be determined.

According to the present invention, in a constitution in which the operation in the forced consumption mode is executable, the toner consumption amount can be suppressed while suppressing the toner deterioration.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 038532/2014 filed Feb. 28, 2014, which is hereby incorporated by reference.

What is claimed is:

1. An image forming apparatus comprising:

an image bearing member;

a developing device for developing an electrostatic latent image, formed on said image bearing member, with a toner;

a supplying device for supplying the toner to said developing device depending on a consumption amount of a developer; and a controller capable of executing an operation in a forced consumption mode in which the toner is forcedly consumed by said developing device, wherein said controller includes:

a difference calculating portion for calculating a difference between a consumption value depending on an amount of the toner consumed every predetermined unit of image formation and a reference value set for the predetermined unit; and an integrating portion for integrating the difference to obtain an integrated value, wherein when the integrated value is larger than a predetermined threshold, said controller executes the operation in the forced consumption mode so that the toner is consumed in an amount corresponding to a value obtained by multiplying the predetermined threshold by a coefficient of less than 1, wherein when the operation in the forced consumption mode is executed, said integrating portion sets, at a reset value, a value obtained by subtracting the value, obtained by multiplying the predetermined threshold by the coefficient, from the integrated value at the time when the operation is executed, and wherein after the operation in the forced consumption mode is executed, said controller executes the operation in the forced consumption mode every time when an integrated value obtained by integrating the reset value and the difference is larger than the predetermined threshold.

2. An image forming apparatus according to claim 1, wherein said integrating portion integrates the difference from zero when use of said developing device is started from an unused state.

3. An image forming apparatus according to claim 1, wherein said difference calculating portion calculates the difference by subtracting the consumption value from the reference value, and wherein said controller resets the integrated value by said integrating portion to zero when the integrated value of the difference by said integrating portion is a negative value.

4. An image forming apparatus according to claim 1, wherein when the integrated value is not less than the predetermined threshold, said controller causes said integrating portion to integrate the integrated value at that time and the difference after that time without executing the operation in the forced consumption mode.

5. An image forming apparatus according to claim 1, further comprising an image ratio calculating portion for calculating an average image ratio which is an image ratio per the predetermined unit with respect to a predetermined number of sheets subjected to image formation, where the average image ratio includes a first ratio and a second ratio smaller than the first ratio, wherein said controller makes the coefficient larger when the average image ratio is the second ratio than when the average image ratio is the first ratio.

6. An image forming apparatus according to claim 1, further comprising a driving time calculating portion for calculating a driving time of said developing device every image formation of one sheet, wherein said controller changes the reference value depending on the driving time.

7. An image forming apparatus according to claim 1, wherein when images each having the same image ratio are continuously formed, said controller executes the operation in the forced consumption mode so that the number of sheets subjected to image formation from a time when the integrated value by the integrating portion is zero until the operation in the forced consumption mode is first executed is larger than the number of sheets subjected to image formation from the execution of the forced consumption mode until a subsequent operation in the forced consumption mode is executed.

8. An image forming apparatus according to claim 1, wherein said controller includes said integrating portion for integrating a value relating to the amount of the toner consumed every predetermined unit of image formation, and resets the value integrated by said integrating portion when the value integrated by said integrating portion satisfies a predetermined reset condition by formation of an image having a high image ratio, wherein the predetermined reset condition is such that the value integrated by said integrating portion is reset.

9. An image forming apparatus according to claim 1, wherein said controller executes the operation in the forced consumption mode when the value integrated by said integrating portion is larger than the predetermined threshold.

10. An image forming apparatus comprising:

an image bearing member;

a developing device configured to develop an electrostatic latent image, formed on said image bearing member, with a toner;

a supplying device configured to supply the toner to said developing device; and a controller configured to execute an operation in a forced consumption mode in which the toner is forcedly consumed by transferring the toner from said developing device onto a region of said image bearing member corresponding to an interval between a recording material and a subsequent recording material in an image forming job for continuously outputting images on a plurality of recording materials, wherein when said developing device is first used and a first image forming job for continuously outputting only such an image that an image ratio corresponds to a predetermined ratio or less is executed, the number of recording materials subjected to image formation until the operation in the forced consumption mode is first executed during the first image forming job is a first number of recording materials subjected to image formation, and when said developing device is subjected to at least one operation in the forced consumption mode from an unused state and thereafter a second image forming job is executed immediately after execution of the last operation in the forced consumption mode under the same condition as a condition for the first image forming job, the number of recording materials subjected to image formation until the operation in the forced consumption mode is first executed during the second image forming job is a second number of recording materials subjected to image formation, the first number is larger than the second number.

11. An image forming apparatus comprising:

an image bearing member;

a developing device configured to develop an electrostatic latent image, formed on said image bearing member, with a toner;

a supplying device configured to supply the toner to said developing device; and a controller configured to execute an operation in a forced consumption mode in which the toner is forcedly consumed by transferring the toner from said developing device onto a region of said image bearing member corresponding to an interval between a recording material and a subsequent recording material in an image forming job for continuously outputting images on a plurality of recording materials, wherein when said developing device is first used and a first image forming job for continuously outputting only such an image that information on an amount of the toner consumed per unit driving time of said developing device is less than a predetermined value is executed, the number of recording materials subjected to image formation until the operation in the forced consumption mode is first executed during the first image forming job is a first number of recording materials subjected to image formation, and when said developing device is subjected to at least one operation in the forced consumption mode from an unused state and thereafter a second image forming job is executed immediately after execution of the last operation in the forced consumption mode under the same condition as a condition for the first image forming job, the number of recording materials subjected to image formation until the operation in the forced consumption mode is first executed during the second image forming job is a second number of recording materials subjected to image formation, the first number is larger than the second number.

12. An image forming apparatus comprising:

an image bearing member;

a developing device configured to develop an electrostatic latent image, formed on said image bearing member, with a toner;

a supplying device configured to supply the toner to said developing device ; and a controller configured to execute an operation in a forced consumption mode in which the toner is forcedly consumed by transferring the toner from said developing device onto a region of said image bearing member corresponding to an interval between a recording material and a subsequent recording material in an image forming job for continuously outputting images on a plurality of recording materials, wherein when immediately after execution of the last operation in the forced consumption mode, an image forming job for outputting only such an image that information on an amount of the toner consumed per unit driving time of said developing device is more than a predetermined value is executed and thereafter a first image forming job for continuously outputting only such an image that the information is less than the predetermined value is executed, the number of recording materials subjected to image formation until the operation in the forced consumption mode is first executed during the first image forming job is a first number of recording materials subjected to image formation, and when said developing device is subjected to at least one operation in the forced consumption mode from an unused state and thereafter a second image forming job is executed immediately after execution of the last operation in the forced consumption mode under the same condition as a condition for the first image forming job, the number of recording materials subjected to image formation until the operation in the forced consumption mode is first executed during the second image forming job is a second number of recording materials subjected to image formation, the first number is larger than the second number.

13. An image forming apparatus comprising:

an image bearing member;

a developing device configured to develop an electrostatic latent image, formed on said image bearing member, with a toner;

a supplying device configured to supply the toner to said developing device; and a controller configured to execute an operation in a forced consumption mode in which the toner is forcedly consumed by transferring the toner from said developing device onto a region of said image bearing member corresponding to an interval between a recording material and a subsequent recording material in an image forming job for continuously outputting images on a plurality of recording materials, wherein when immediately after execution of the last operation in the forced consumption mode, an image forming job for outputting only such an image that an image ratio is higher than a predetermined ratio is executed and thereafter a first image forming job for continuously outputting only such an image that the image ratio is less than the predetermined ratio is executed, the number of recording materials subjected to image formation until the operation in the forced consumption mode is first executed during the first image forming job is a first number of recording materials subjected to image formation, and when said developing device is subjected to at least one operation in the forced consumption mode from an unused state and thereafter a second image forming job is executed immediately after execution of the last operation in the forced consumption mode under the same condition as a condition for the first image forming job, the number of recording materials subjected to image formation until the operation in the forced consumption mode is first executed during the second image forming job is a second number of recording materials subjected to image formation, the first number is larger than the second number.

14. An image forming apparatus comprising:

an image bearing member;

a developing device configured to develop an electrostatic latent image, formed on said image bearing member, with a toner;

a supplying device configured to supply the toner to said developing device; and a controller configured to execute an operation in a forced consumption mode in which the toner is forcedly consumed by transferring the toner from said developing device onto a region of said image bearing member corresponding to an interval between a recording material and a subsequent recording material in an image forming job for continuously outputting images on a plurality of recording materials, wherein said controller is configured to execute the operation in the forced consumption mode when an integrated value of deterioration information determined on the basis of a consumption value depending on an amount of the toner consumed every predetermined unit of image formation and a reference value set for the predetermined unit is larger than a predetermined threshold, wherein the operation in the forced consumption mode is an operation in a mode in which a part of the toner is consumed in an amount corresponding to the integrated value, and wherein said controller resets the integrated value to a positive value smaller than the predetermined threshold depending on execution of the operation in the forced consumption mode.

15. An image forming apparatus comprising:

an image bearing member;

a developing device configured to develop an electrostatic latent image, formed on said image bearing member, with a toner;

a supplying device configured to supply the toner to said developing device; and a controller configured to execute an operation in a forced consumption mode in which the toner is forcedly consumed by transferring the toner from said developing device onto a region of said image bearing member corresponding to an interval between a recording material and a subsequent recording material in an image forming job for continuously outputting images on a plurality of recording materials, wherein said controller is configured to execute the operation in the forced consumption mode in which the toner is forcedly consumed by said developing device when an integrated value of deterioration information determined on the basis of information on an amount of the toner consumed per unit driving time of said developing device and a predetermined value is larger than a predetermined threshold, wherein the operation in the forced consumption mode is an operation in a mode in which a part of the toner is consumed in an amount corresponding to the integrated value, and wherein said controller resets the integrated value to a positive value smaller than the predetermined threshold depending on execution of the operation in the forced consumption mode.

* * * * *